US011359629B2

(12) United States Patent
Park et al.

(10) Patent No.: US 11,359,629 B2
(45) Date of Patent: Jun. 14, 2022

(54) MOTOR OPERATED COMPRESSOR

(71) Applicant: LG ELECTRONICS INC., Seoul (KR)

(72) Inventors: Honghee Park, Seoul (KR); Junghoon Park, Seoul (KR); Kyoungjun Park, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 110 days.

(21) Appl. No.: 17/013,064

(22) Filed: Sep. 4, 2020

(65) Prior Publication Data

US 2021/0071663 A1 Mar. 11, 2021

(30) Foreign Application Priority Data

Sep. 5, 2019 (KR) ..... 10-2019-0110325

(51) Int. Cl.
*F04C 18/02* (2006.01)
*F04C 27/00* (2006.01)
*F04C 23/02* (2006.01)

(52) U.S. Cl.
CPC ..... *F04C 18/0215* (2013.01); *F04C 23/02* (2013.01); *F04C 27/005* (2013.01); (Continued)

(58) Field of Classification Search
CPC ..... F04C 18/0215; F04C 18/0269; F04C 18/0253; F04C 23/02; F04C 27/005; (Continued)

(56) References Cited

U.S. PATENT DOCUMENTS 4,732,550 A * 3/1988 Suzuki ..... F01C 1/0215 418/55.4
8,057,202 B2 * 11/2011 Haller ..... F04C 27/005 418/55.4

(Continued)

FOREIGN PATENT DOCUMENTS

JP 2013-148020 A 8/2013
KR 2013-0102351 A 9/2013

(Continued)

OTHER PUBLICATIONS

Office Action for Korean Application No. KR 10-2019-0110325, dated Nov. 23, 2020 (7 pages).

*Primary Examiner* — Audrey B. Walter
*Assistant Examiner* — Dapinder Singh
(74) *Attorney, Agent, or Firm* — Birch, Stewart, Kolasch & Birch, LLP

(57) ABSTRACT

A motor operated compressor according to the present embodiment may include a main housing; an electric motor unit; a rotation shaft; a fixed scroll coupled to an inner space of the main housing; an orbiting scroll provided that performs an orbiting movement with respect to the fixed scroll; a rear housing provided on an opposite side to the fixed scroll with the orbiting scroll therebetween and coupled to the main housing, and disposed with a first space to communicate with a discharge side of the compression chamber; and a first sealing portion provided to surround the first space to form a second space on an outer edge of the first space, wherein the second space includes a first region and a second region in fluid communication with each other. Accordingly, a horizontal motor operated compressor in which a frame and a fixed scroll are integrated may be provided.

18 Claims, 14 Drawing Sheets

(52) U.S. Cl.
CPC ..... *F04C 18/0269* (2013.01); *F04C 2240/30* (2013.01); *F04C 2240/40* (2013.01)

(58) Field of Classification Search
CPC ..... F04C 27/008; F04C 29/0021; F04C 2240/30; F04C 2240/40; F04C 2240/803; F04C 2240/80; F04C 2210/26; F05B 2210/14; F05B 2240/57
See application file for complete search history.

(56) References Cited

U.S. PATENT DOCUMENTS 8,647,085 B2 * 2/2014 Iwano ..... F04C 18/0215 418/55.4
2015/0037190 A1 * 2/2015 Smerud ..... F01C 17/066 418/55.3

FOREIGN PATENT DOCUMENTS

KR 20140136796 A 12/2014
KR 10-1544644 B1 8/2015

* cited by examiner

MOTOR OPERATED COMPRESSOR

CROSS-REFERENCE TO RELATED APPLICATIONS

Pursuant to 35 U.S.C. § 119(a), this application claims the benefit of an earlier filing date of and the right of priority to Korean Patent Application No. 10-2019-0110325, filed on Sep. 5, 2019, the contents of which are incorporated by reference herein in its entirety.

BACKGROUND

1. Technical Field

The present disclosure relates to a compressor, and more particularly, to a motor-driven scroll-type motor operated compressor.

2. Description of the Related Art

Compressors are divided into mechanical type compressors using an engine as a driving source and electric type compressors using a motor as a driving source. As a motor operated compressor, a scroll compression method suitable for a high compression ratio operation is widely known.

An electric motor unit composed of a drive motor is provided within a sealed casing of a scroll compression type motor operated compressor (hereinafter, abbreviated as a motor operated compressor). Furthermore, a compression unit including a fixed scroll and an orbiting scroll is provided on one side of the electric motor unit. The electric motor unit and the compression unit are connected to the rotation shaft. A rotational force of the electric motor unit is transmitted to the compression unit through the rotation shaft. Furthermore, the compression unit compresses fluid such as refrigerant by a rotational force transmitted through the rotation shaft.

The motor operated compressor may be mounted on an electric vehicle to constitute a refrigeration cycle of the electric vehicle. Electric vehicles have a relatively low output than engine-driven vehicles, so it is important to keep the weight of vehicle parts as low as possible. Therefore, when the motor operated compressor is made small and light, it is advantageous to reduce the installation space and, at the same time, to reduce the weight in the electric vehicle.

However, a motor operated compressor in the related art has a limitation in reducing the size of the compressor and reducing the weight as the fixed scroll and the orbiting scroll constituting a compression unit are supported by a frame. Accordingly, in Korean Patent Application Publication No. 10-2014-0136796 (hereinafter, referred to as patent document), a frame scroll type compressor that excludes a frame supporting a fixed scroll and an orbiting scroll and additionally serves as a frame using a fixed scroll is proposed.

However, the patent document is mainly developed not only as a compressor for an air conditioner, but also consists of a vertical compressor in which a transmission unit and a compression unit are arranged in a vertical direction. On the contrary, a vehicle compressor is typically composed of a horizontal compressor in which an electric motor unit and a compression unit are typically arranged in a horizontal direction. Therefore, it is not suitable to employ a motor operated compressor in the related art described in the patent document in a vehicle. Accordingly, there is a need to develop a frame scroll type motor operated compressor as well as a horizontal type that can be employed in a vehicle.

SUMMARY

An aspect of the present disclosure is to provide a horizontal motor operated compressor to which a frame scroll is applied.

Furthermore, an aspect of the present disclosure is to provide a motor operated compressor capable of reducing the number of sealing members to reduce manufacturing cost.

In addition, another aspect of the present disclosure is to provide a motor operated compressor capable of reducing the number of pressures acting around an orbiting scroll to reduce the number of sealing members.

Moreover, still another aspect of the present disclosure is to provide a motor operated compressor capable of securing an orbiting scroll with a wide back pressure area toward a frame scroll to stably support the orbiting scroll.

Besides, yet still another aspect of the present disclosure is to provide a motor operated compressor capable of efficiently supplying oil separated from refrigerant to a bearing surface as well as simplifying an oil feeding structure.

In order to achieve the objectives of the present disclosure, there may be provided a motor operated compressor, including a frame scroll provided to face a drive motor; an orbiting scroll in engagement with the frame scroll to form a compressed space; and a housing provided on an opposite side to the frame scroll to support the orbiting scroll, wherein a first sealing member is provided between the orbiting scroll and the housing, and a second sealing member is provided between the frame scroll and the housing, and a third sealing member is provided between the frame scroll and the orbiting scroll.

Here, a discharge pressure and an intermediate pressure may be respectively formed on both sides of the first sealing member, and a discharge pressure and a suction pressure may be respectively formed on both sides of the second sealing member, and an intermediate pressure and a suction pressure may be respectively formed on both sides of the third sealing member.

Furthermore, in order to achieve the objectives of the present disclosure, there may be provided a motor operated compressor, including a frame scroll provided to face a drive motor; an orbiting scroll in engagement with the frame scroll to form a compressed space; and a housing provided on an opposite side to the frame scroll to support the orbiting scroll, wherein a first region is formed between the orbiting scroll and the housing, and a second region is formed between an outer circumferential surface of the orbiting scroll and an inner circumferential surface of the fixed scroll, and the first region and the second region that communicate with each other.

Here, the first region may be separated from a discharge pressure space by a first sealing portion provided between the orbiting scroll and the housing, and the second region may be separated from a suction pressure space by a second sealing portion provided between an outer circumferential surface of the fixed scroll and an inner circumferential surface of the housing.

In addition, in order to achieve the objectives of the present disclosure, there may be provided a motor operated compressor, wherein a frame scroll, an orbiting scroll, and a rear housing are sequentially provided with respect to a drive motor provided in a main housing, and the rear housing is provided with a first space communicating with discharge port and a second space communicating with the first space and disposed with an exhaust port, and a first sealing member is provided between the rear housing and a rear surface of the orbiting scroll, and the second sealing member is provided between the main housing and the frame scroll.

Here, the second sealing member may be provided between an outer circumferential surface of the frame scroll and an inner circumferential surface of the main housing or an inner circumferential surface of the rear housing facing the same.

Here, the second sealing member may be provided between an axial support surface disposed on one axial side surface of the fixed scroll and an inner circumferential surface of the main housing facing the same.

Moreover, in order to achieve the objectives of the present disclosure, there may be provided a motor operated compressor, wherein a support plate is provided between an orbiting scroll and a housing that supports the orbiting scroll in a frame scroll direction, and a housing-side sealing portion is provided between one side surface of the support plate and the rear housing facing the same, and a scroll-side sealing portion is provided between the other side of the support plate and a rear surface of the orbiting scroll facing the same, and at least one sealing portion between the housing-side sealing portion and the scroll-side sealing portion is provided with a sealing protrusion extending axially from the rear housing or the orbiting scroll.

In addition, in order to achieve the objectives of the present disclosure, there may be provided a motor operated compressor, including a main housing; an electric motor unit provided at inner space of the main housing; a rotation shaft coupled to the electric motor unit to rotate; a fixed scroll coupled to the inner space of the main housing, and disposed with a fixed wrap on one side surface of a fixed end plate portion; an orbiting scroll provided with an orbiting wrap engaged with the fixed wrap to form a compression chamber on one side of an orbiting end plate portion to perform an orbiting movement with respect to the fixed scroll; a rear housing provided on an opposite side to the fixed scroll with the orbiting scroll therebetween and coupled to the main housing, and disposed with a first space to communicate with a discharge side of the compression chamber; and a first sealing portion provided to surround the first space to form a second space on an outer edge of the first space.

Here, the second space may include a first region disposed between an axial side surface of the orbiting end plate portion and the rear housing facing the axial side surface of the orbiting end plate portion; and a second region disposed between an outer circumferential surface of the orbiting end plate portion and an inner circumferential surface of the fixed scroll facing outer circumferential surface of the orbiting end plate portion, and the first region and the second region communicate with each other.

Here, the motor operated compressor may further include a second sealing portion provided between the fixed scroll and the main housing or the rear housing facing the fixed scroll to separate the second space from the inner space of the main housing.

Here, the fixed end plate portion may be provided with a sidewall portion on an outer edge of the fixed wrap, and a third sealing portion may be provided between an end surface of the sidewall portion and one side surface of the orbiting end plate portion facing the end surface of the sidewall portion to separate the second space portion from the compression chamber.

Furthermore, the fixed end plate portion may be disposed with a suction port communicating the inner space of the main housing to the compression chamber, and the third sealing portion may be located on an outer edge than the suction port in a radial direction.

Furthermore, the third sealing portion may include a third sealing groove provided on an end surface of the sidewall portion or one side surface of the orbiting end plate portion facing the sidewall portion, and a sealing member inserted into the third sealing groove to float by a pressure of the second space portion.

Here, an annular support plate may be provided between the orbiting scroll and the rear housing, and the first sealing portion may include a housing-side sealing portion provided between the rear housing and one side surface of the support plate facing the rear housing, and a scroll-side sealing portion provided between the orbiting scroll and the other side surface of the support plate facing the orbiting scroll.

Furthermore, at least either one of the housing-side sealing portion and the scroll-side sealing portion may include a first sealing groove provided in the rear housing or the orbiting scroll, and a sealing member inserted into the first sealing groove to float toward the support plate by a pressure difference between the first space and the second space.

Furthermore, at least either one of the housing-side sealing portion and the scroll-side sealing portion may include a sealing protrusion extending from the rear housing or the orbiting scroll toward the support plate.

Here, at least part of the housing-side sealing portion and the scroll-side sealing portion may be disposed at a position overlapping with each other in a radial direction.

Here, the first sealing portion may include a first sealing groove provided in the rear housing or the orbiting scroll, and a first sealing member inserted into the first sealing groove to float toward an opposite member by a pressure difference between the first space and the second space.

Here, the second sealing portion may include a second sealing groove provided on an outer surface of the fixed scroll and an inner surface of the main housing or the rear housing facing the fixed scroll, and a second sealing member inserted into the second sealing groove to be brought into close contact with the outer surface of the fixed scroll and the inner surface of the main housing or the rear housing facing the outer surface of the fixed scroll.

Here, the rear housing may include an intermediate pressure space portion recessed by a predetermined depth from an opening side end surface facing the main housing to form the second space; a discharge pressure space portion recessed by a predetermined depth from the intermediate pressure space portion with the first sealing portion therebetween to form the first space; an oil separation space portion configured to communicate with the discharge pressure space portion and provided with an exhaust port on one side thereof; and a first passage communicating between the oil separation space portion and the intermediate pressure space portion.

Furthermore, an annular protrusion may be disposed between the intermediate pressure space portion and the discharge pressure space portion, and the first sealing member may be provided in the annual protrusion.

Furthermore, the first passage may communicate with the intermediate pressure space portion at an outer edge in a radial direction than the first sealing portion, and a decompression portion may be provided in the first passage.

Furthermore, a support plate may be provided between the rear housing and the orbiting scroll, and a second passage communicating with the first passage may be disposed in the support plate, and a third passage communicating with the second passage may be disposed in the orbiting scroll, and the third passage may be provided on the orbiting end plate portion to communicate with an inner space of a rotation shaft coupling portion to which the rotation shaft is coupled.

Furthermore, an end portion of the rotation shaft coupled to the rotation shaft coupling portion may be disposed with a fourth passage passing from an end surface thereof to an outer circumferential surface of the rotation shaft.

DETAILED DESCRIPTION OF THE EMBODIMENTS

Hereinafter, a motor operated compressor according to the present embodiment will be described in detail with reference to an embodiment illustrated in the accompanying drawings.

Figure 1:
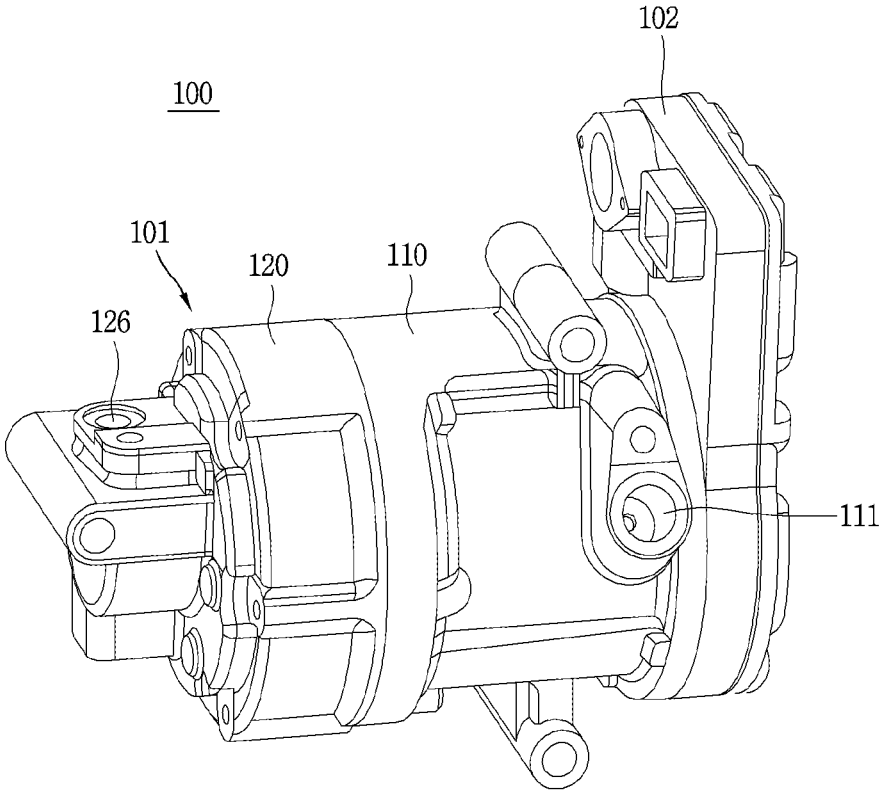
FIG. 1 is a perspective view showing an appearance of a motor operated compressor according to the present embodiment.

FIG. 1 is a perspective view showing an appearance of a motor operated compressor according to the present embodiment.

Referring to FIG. 1, a motor operated compressor 100 according to the present embodiment includes a compression module 101 and an inverter module 102. The compression module 101 refers to a set of components for compressing a fluid such as refrigerant, and the inverter module 102 refers to a collection of components for controlling the operation of the compression module 101. The inverter module 102 may be coupled to a front side of the compression module 101. Hereinafter, a side at which the inverter module 102 is provided is defined as a front side, and a side at which the compression module 101 is provided is defined as a rear side.

A fluid subject to compression (hereinafter, refrigerant) flows into compressor 100 through an intake port 111 and is discharged out of the compressor 100 through an exhaust port 126. Therefore, it is advantageous for the inverter module 102 to be disposed at the front side close to the intake port 111 so as to cool the inverter module 102.

An appearance of the compressor module 101 may be defined by a main housing 110 constituting a first housing, and a rear housing 120 constituting a second housing. For example, the main housing 110 is defined in a shape that the front end portion is closed and the rear end portion is open, and the rear housing 120 is defined in a shape that the front end portion is open and the rear end portion is closed. Accordingly, a rear end portion of the main housing 110 and a front end portion of the rear housing 120 communicate with each other to define a sealed casing.

Figure 2:
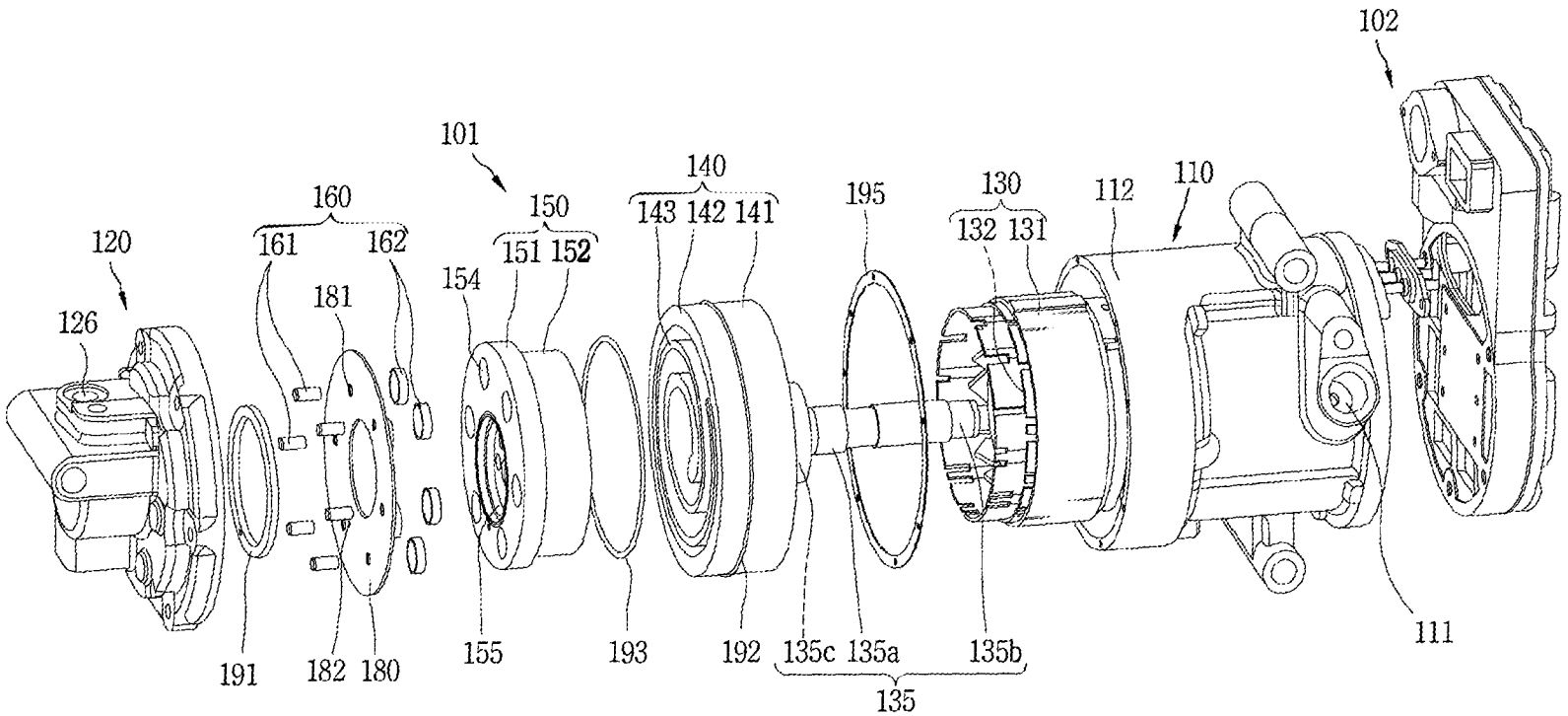
FIG. 2 is an exploded perspective view showing the motor operated compressor according to FIG. 1.
Figure 3:
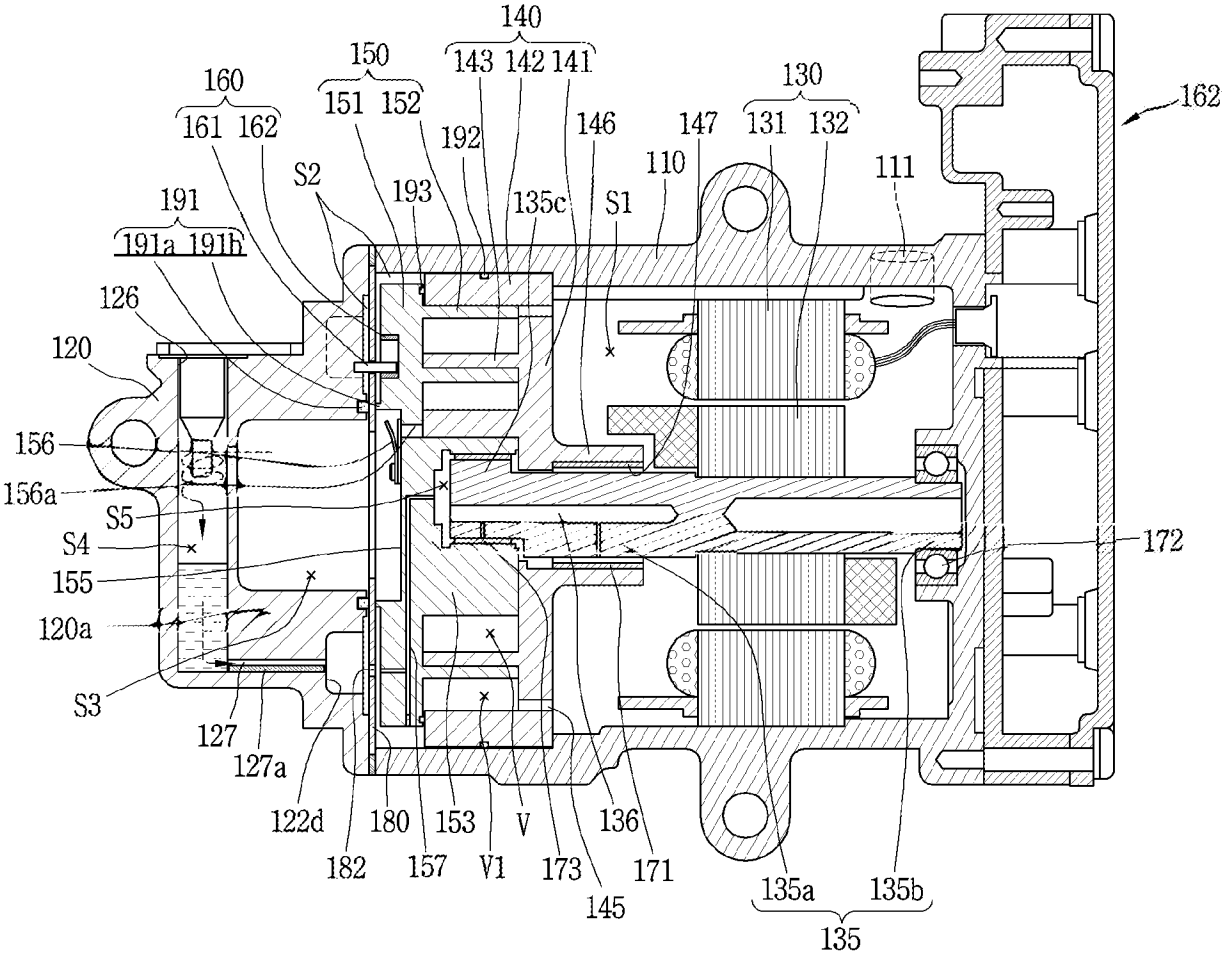
FIG. 3 is an assembled cross-sectional view showing an inside of the motor operated compressor according to FIG. 2.

FIG. 2 is an exploded perspective view showing the motor operated compressor according to FIG. 1, and FIG. 3 is an assembled cross-sectional view showing an inside of the motor operated compressor according to FIG. 2.

Referring to FIGS. 2 and 3, the main housing 110 has a hollow circular cylinder or polygonal cylinder, or an appearance equivalent thereto. The main housing 110 may be disposed to extend in a transverse direction. The main housing 110 is disposed to surround an electric motor unit 130 which will be described later. An axial one end of the main housing 110 may be defined in a closed shape and the other axial end thereof may be open.

The intake port 111 is disposed on an outer circumferential surface of the main housing 110. The intake port 111 defines a passage that supplies refrigerant (for example, R134a, R32, CO2, etc.) to an internal space of the compression module 101.

The rear housing 120 is coupled to a rear end portion of the main housing 110. The rear housing 120 may be disposed to cover a rear end portion of the main housing 110. The exhaust port 126 may be disposed at the rear housing 120, and an oil separator 123*a* may be provided at the exhaust port 126.

In addition, the rear housing 120 is provided to face a rear surface of the orbiting scroll 150 to be described later, so as to form a plate support portion 121, an intermediate pressure space portion 122, a discharge pressure space portion 123, an oil separation space portion 124, which will be described later.

Next, the compression module will be described.

Referring again to FIGS. 2 and 3, for the compression module 101, an electric motor unit (a drive unit or drive motor) 130 and a compression unit 105 are axially arranged in an inner space of the main housing 110 constituting part of the casing, and the electric motor unit 130 and the compression unit 105 are connected by a rotation shaft 135. The electric motor unit 130 is located at a front side of the main housing 110, and the compression unit 105 is located at a rear side of the main housing 110, respectively.

Here, as the intake port 111 is disposed in the main housing 110, an inner space of the main housing 110 defines a suction space (S1), and the electric motor unit 130 and the compression unit 105 are arranged in the suction space (S1) forming a suction pressure. The suction space (S1) may also be referred to as a motor chamber.

The electric motor unit 130 is disposed to generate a driving force for performing an orbiting movement of the orbiting scroll 150 in the compression unit 105. The electric motor unit 130 is also referred to as a drive motor, and is composed of an electric motor.

The electric motor unit 130 includes a stator 131 and a rotor 132.

The stator 131 is inserted into and fixed to an inner circumferential surface of the main housing 110 by heat shrinking (or hot pressing). However, the stator may be fixed by welding after insertion or fixed using another fixing member.

The rotor 132 may be rotatably disposed inside the stator 131. When power is applied to the stator 131, the rotor 1132 is rotated by electromagnetic interaction with the stator 131.

The rotation shaft 135 is coupled to the center of the rotor 132. An eccentric portion 135*c* is disposed on the rotation shaft 135 and eccentrically coupled to the orbiting scroll 150. Accordingly, the rotation shaft 135 transmits a rotational force of the drive motor to the orbiting scroll 150. The rotation shaft will be described again later.

Figure 4:
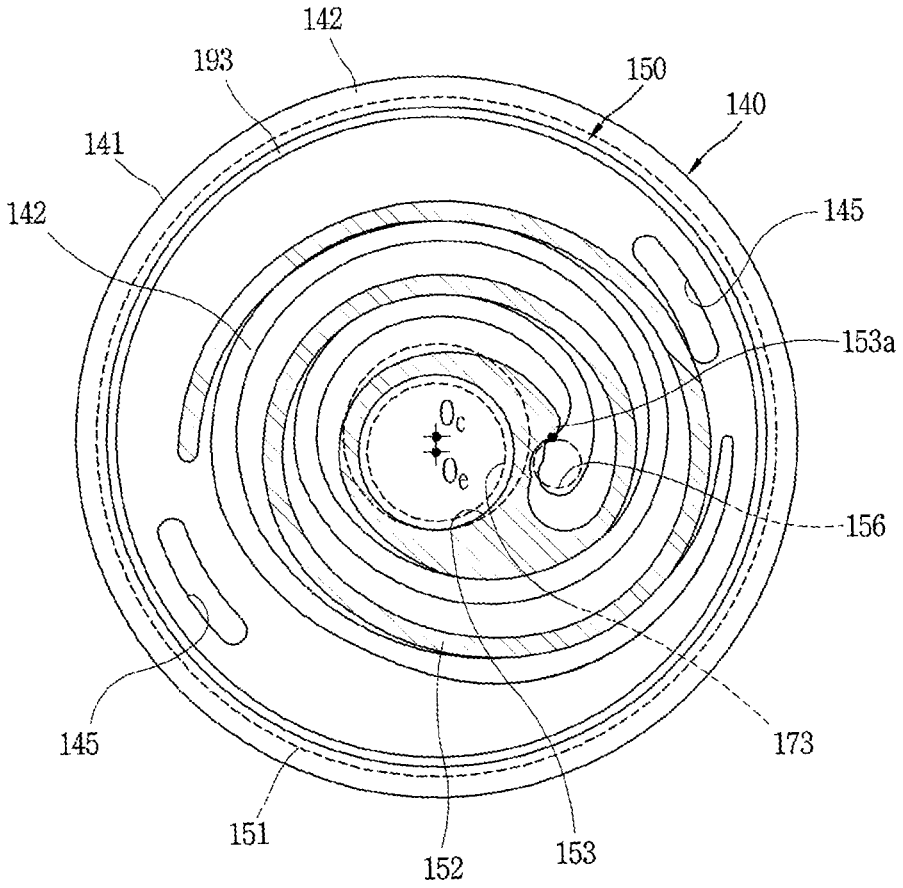
FIG. 4 is a plan view showing a coupled state between a fixed scroll and an orbiting scroll of a compression unit in a motor operated compressor.

Subsequently, the compression unit will be described. FIG. 4 is a plan view showing a coupled state between a fixed scroll and an orbiting scroll of a compression unit in a motor operated compressor.

Referring to FIG. 4, the compression unit 105 includes a fixed scroll 140 and an orbiting scroll 150. The fixed scroll 140 may be defined as a first scroll, and the orbiting scroll 150 may be defined as a second scroll, respectively. Furthermore, the fixed scroll 140 may also be referred to as a frame scroll. The frame scroll is a member in which a frame and a fixed scroll are mixed, and serves as both a frame supporting a rotating shaft and a fixed scroll forming a compression chamber. Therefore, the fixed scroll in the following description is a name embracing a frame scroll.

The fixed scroll 140 and the orbiting scroll 150 are coupled to each other to form a pair of compression chambers (V). As the orbiting scroll 150 performs an orbiting movement, a volume of the compression chamber is repeatedly changed, and thereby refrigerant is compressed in the compression chamber (V).

The fixed scroll 140 is disposed relatively close to the electric motor unit 130, and the orbiting scroll 150 is disposed relatively far from the electric motor unit 130. The fixed scroll 140 is axially disposed between the orbiting scroll 150 and the main housing 110. The orbiting scroll 150 is axially disposed between the fixed scroll 140 and the rear housing 120.

Referring to FIGS. 3 and 4, the fixed scroll 140 according to the present embodiment includes a fixed end plate portion 141, a sidewall portion 142, and a fixed wrap 143.

The fixed end plate portion 141 is defined in a substantially disc shape. A suction port 145 communicating between a suction space (S1) and a suction chamber (V1) is disposed to pass through an edge of the fixed end plate 141. Therefore, a scroll support surface 112 of the main housing 110, which will be described later, is preferably disposed to have a radial width to an extent that does not cover the suction port 145.

A rotation shaft support protrusion 146 axially extending toward the electric motor unit 130 is disposed in a central portion of the fixed end plate portion 141, and a rotation shaft receiving portion 147 is disposed at the rotation shaft support protrusion 146 to axially pass therethrough. Accordingly, the rotation shaft support protrusion 146 is defined in a bush shape.

The main bearing 171 is inserted into and fixed to an inner circumferential surface of the rotation shaft receiving portion 147 so that a main bearing portion 135*a* of the rotation shaft 135 is inserted and supported radially. The main bearing 171 may be composed of a ball bearing, but in the present embodiment, a bush bearing is applied to reduce manufacturing cost for the compressor and reduce friction loss and vibration noise.

A front end of the rotation shaft receiving portion 147 may be provided with a sealing member (not shown) for sealing between the rotation shaft 135 and the first scroll 140. Accordingly, for the rotation shaft 135, the main bearing portion 135*a* disposed at a rear side of the rotor 132 in the electric motor unit 130 is radially supported by the fixed scroll 140.

Here, a sub bearing portion 135*b* disposed at a front side of the rotation shaft 135 may be supported by a sub bearing 172 provided on a front side surface of the main housing 110. The sub bearing 172 may be composed of a ball bearing, and inserted into and coupled to a shaft support portion 113 provided on a front inner surface of the main housing 110. As the sub bearing 172 is composed of a ball bearing, the rotation shaft 135 is supported by the sub-bearing 172 in radial and axial directions.

Referring to FIGS. 3 and 4, the sidewall portion 142 of the fixed scroll 140 according to the present embodiment extends in an axial direction by a predetermined height from a rear surface of the fixed end plate portion 141, and is defined in an annular shape along a circumferential direction.

Here, the fixed scroll 140 may be pressed into and fixed to an inner circumferential surface of the main housing 110, and supported and fixed in both axial directions between the main housing 110 and the rear housing 120.

Referring to FIG. 4, the fixed wrap 143 is disposed to protrude toward the orbiting scroll 150 from a rear surface of the fixed end plate portion 141 facing the orbiting scroll 150. The fixed wrap 143 may be defined in an involute shape, but in the present embodiment, as the rotation shaft 135 is inserted into and coupled to the orbiting scroll 150 through the fixed scroll 140, the fixed wrap 143 may be defined in a non-involute shape. The shape of the fixed wrap will be described later together with the orbiting wrap.

Meanwhile, the orbiting scroll 150 according to the present embodiment is disposed at a position facing the fixed scroll 140. The orbiting scroll 150 is coupled to the eccentric portion 135*c* provided at a rear end of the rotation shaft 135. Accordingly, the orbiting scroll 150 is eccentrically coupled to the rotation shaft 135. The orbiting scroll 150 that has received a rotational force through the eccentric portion 135*c* performs an orbiting movement by an anti-rotation mechanism 160.

Referring to FIGS. 3 and 4, the orbiting scroll 150 according to the present embodiment includes an orbiting end plate portion 151, an orbiting wrap 152 and a rotation shaft coupling portion 153.

The orbiting end plate portion 151 may be defined in a plate shape corresponding to the fixed end plate portion 141. When the fixed end plate portion 141 has a disc-shaped cross section, the orbiting end plate portion 151 has a disc-shaped cross section.

The orbiting wrap 152 constituting the compression chamber (V) in engagement with the fixed wrap 143 is disposed on a front surface facing the fixed scroll 140 between both axial side surfaces of the orbiting end plate portion 151.

The orbiting wrap 152 according to the present embodiment may protrude in an involute curve, an arithmetic spiral (Archimedean spiral), or an algebraic spiral (logarithmic spiral) shape. However, the orbiting wrap 152 according to the present embodiment may be defined in a non-involute shape together with the fixed wrap 143. In other words, the orbiting wrap 152 and the fixed wrap 143 may be defined as an atypical curve connecting a plurality of curves.

Through this, it may be possible to reduce a pressure difference between a compression pocket disposed on the outside and a compression pocket formed on the inside with respect to the fixed wrap 143 while forming an axial through scroll compressor in which the rotation shaft 135 is coupled to radially overlap with the orbiting wrap 152 of the orbiting scroll 150 through the fixed scroll 140. For example, as shown in FIG. 4, the orbiting wrap 152 according to the present embodiment may disposed with a protruding portion 153*a* at a discharge-side end constituting the rotation shaft coupling portion 153 to extend a crank angle (compression angle) of the inner compression pocket. Through this, a compression angle of the inner compression pocket may be increased to extend compression cycle, and a compression ratio of the inner compression pocket may be increased to minimize a pressure difference between both compression pockets.

The rotation shaft coupling portion 153 protrudes from the center of the orbiting end plate portion 151 toward the fixed end plate portion 141. For example, the rotation shaft coupling portion 153 may be disposed at a position corresponding to a base circle defining the orbiting wrap 152. Accordingly, the rotation shaft coupling portion 153 defines the innermost portion of the orbiting wrap 152.

The rotation shaft coupling portion 153 may be defined in a hollow cylindrical shape to accommodate the eccentric portion 135*c* of the rotation shaft 135. The rotation shaft coupling portion 153 is disposed to surround the eccentric portion 135*c* of the rotation shaft 135.

The rotation shaft coupling portion 153 of the orbiting scroll 150 is open to only one side thereof. For example, the rotation shaft coupling portion 153 of the orbiting scroll 150 is open toward the fixed end plate portion 141, but a rear surface opposite to the open portion is closed by the orbiting end plate portion 151. Therefore, the eccentric portion 135*c* of the rotation shaft 135 may be inserted into the rotation shaft coupling portion 153 of the orbiting scroll 150, but does not pass through the orbiting end plate portion 151.

A rear surface of the rotation shaft coupling portion 153 is spaced apart by a predetermined distance from an end surface of the eccentric portion 135*c* of the rotation shaft 135. Accordingly, a predetermined oil storage space (S5) is disposed on a rear side of the rotation shaft coupling portion 153 with the rotation shaft 135 therebetween.

Meanwhile, referring to FIG. 2, a plurality of anti-rotation grooves 154 and discharge guide grooves 155 are disposed on a rear surface of the orbiting end plate portion 151.

The plurality of anti-rotation grooves (exactly, anti-rotation rings) 154 define an anti-rotation mechanism 160 that prevents the rotation of the orbiting scroll 150 together with the anti-rotation pins 161, and the plurality of anti-rotation grooves 154 are arranged at predetermined intervals along the circumferential direction.

Furthermore, the plurality of anti-rotation grooves 154 may be arranged to correspond one-to-one to the plurality of anti-rotation pins 161. The anti-rotation rings 162 are inserted into and coupled to the plurality of anti-rotation grooves 154, respectively. Accordingly, the anti-rotation pins 161 are rotatably inserted into the anti-rotation rings 162.

The discharge guide groove 155 is defined to be engraved by a predetermined depth in the center of the orbiting end plate portion 151, and a discharge port 156 for discharging refrigerant compressed in the compression chamber (V) to a discharge space (S3), which will be described later, is disposed inside the discharge guide groove 155. The discharge port 156 is disposed eccentrically from the center of the orbiting end plate portion 151 so as not to interfere with the rotation shaft coupling portion 153. Accordingly, the discharge guide groove 155 may also be disposed eccentrically from the center of the orbiting end plate portion 151. A check valve 156*a* serving as a discharge valve to open and close the discharge port 156 is provided at a discharge-side end portion of the discharge port 156.

A sealing protrusion 1913 constituting part of a first sealing portion 191 may be disposed around the discharge guide groove 155. The sealing protrusion 1913 is to close between a space constituting the discharge chamber and a space forming the back pressure chamber, which will be described later with reference to an intermediate pressure space portion.

Meanwhile, a support plate 180 is provided between a rear surface of the orbiting scroll 150 and a front surface of the rear housing 120. The first sealing portion 191 is provided on both axial side surfaces of the support plate 180 to divide a space between a rear side of the orbiting scroll 150 and a front side of the rear housing 120 into a plurality of spaces, i.e., the discharge chamber (S3) and the back pressure chamber (S2). This will be described again later.

The support plate 180 may be provided to reduce friction loss and abrasion with the rear housing 120 during the orbiting movement of the orbiting scroll 150, and therefore, the thrust plate 180 may be made of a material having a higher wear resistance than that of the orbiting scroll 150 or the rear housing 120.

In addition, the support plate 180 may be mounted on the plate support portion 121 of the rear housing 120, which will be described later, and fixed to a coupling surface between the rear housing 120 and the main housing 110. In this case, a housing sealing member 195 such as a gasket may be provided on both axial side surfaces or one side surface of the support plate 180. Alternatively, the housing sealing member 195 may be radially located at an outer side than the support plate 180.

Furthermore, the support plate 180 is disposed with a plurality of pin holes 180*a* through which the anti-rotation pins 161 are coupled to each other at preset intervals along a circumferential direction. The pin hole 181 is disposed at a position corresponding to an anti-rotation ring provided on the orbiting scroll. The pin hole 181 is defined approximately equal to or slightly larger than the anti-rotation pin 161.

In addition, an oil communication hole 182 is disposed in the support plate 180. The oil communication hole 182 may be disposed around the pin hole 181. For example, the oil communication hole 182 may be disposed at an inner side than the pin hole 181.

However, the oil communication hole 182 may be disposed at an outer side than the pin hole 181 or may be disposed on the same circumference as the pin hole 180*b*. In some cases, the oil communication hole 182 may overlap with the pin hole 181, or one pin hole 181 may be defined to be larger than the other pin hole 181 to replace the oil communication hole 182. This will be described again later together with an oil feeding structure.

In the drawing, reference numeral 122*f* is a pin fixing groove.

The foregoing motor operated compressor according to the present embodiment operates as follows.

In other words, when power is applied to the drive motor 130, the rotation shaft 135 transfers a rotational force to the orbiting scroll 150 while rotating together with the rotor 132, and the orbiting scroll 150 performs an orbiting movement with respect to the fixed scroll 140 by the anti-rotation ring 162 and the anti-rotation pin 161. Then, the compression chamber (V) is reduced in volume while continuously moving toward the center.

Then, refrigerant flows into the motor chamber (S1) that is a suction space through the intake port 111 and the refrigerant flowed into the motor chamber (S1) is sucked into the compression chamber (V) through a passage disposed on an outer circumferential surface of the stator 131 and an inner circumferential surface of the main housing 110 or a gap between the stator 131 and the rotor 132.

Then, a series of processes are repeated in which the refrigerant is compressed by the orbiting scroll 140 and the fixed scroll 150 and discharged to the rear housing through the discharge port 156, and the refrigerant discharged to the rear housing is separated into refrigerant and oil in the rear housing, and the separated refrigerant is discharged through the exhaust port while the separated oil moves to each bearing surface and compression chamber through an oil return passage.

On the other hand, in a frame scroll type horizontal motor operated compressor according to the present disclosure, the orbiting scroll is located between the fixed scroll and the rear housing to perform an orbiting movement. Accordingly, a back pressure chamber is disposed between the orbiting scroll and the rear housing to support the orbiting scroll in a direction toward the fixed scroll.

The back pressure chamber may be disposed such that the pressure of the back pressure chamber forms a discharge pressure. However, when the pressure of the back pressure chamber defines the discharge pressure, the orbiting scroll is excessively pushed toward the fixed scroll. Then, friction loss between both scrolls may increase during high-speed operation. Therefore, when the pressure of the compression chamber does not form an ultra-high pressure, the pressure of the back pressure chamber is preferably formed to achieve an intermediate pressure. Hereinafter, in the motor operated compressor according to the present disclosure, coupling relationship between each member will be described separately around the back pressure chamber.

Figure 5:
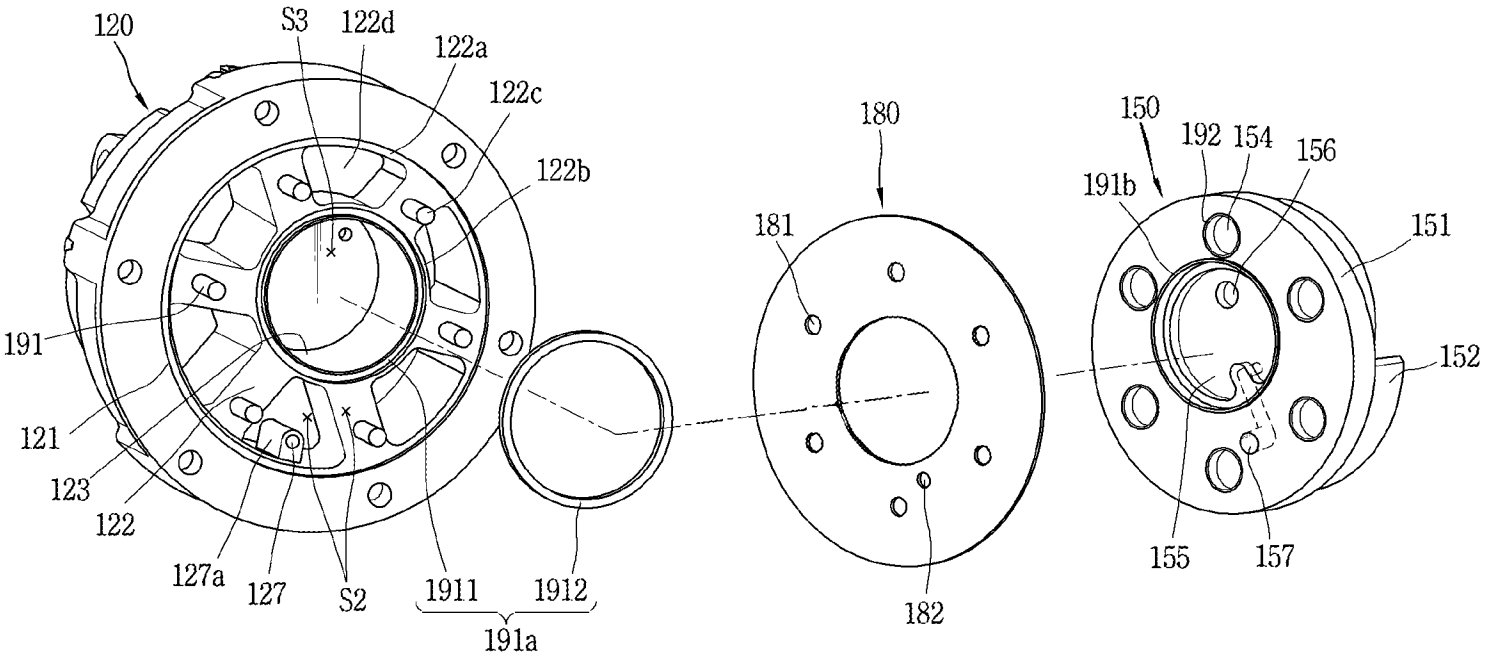
FIG. 5 is an exploded perspective view showing members constituting a back pressure chamber in a motor operated compressor.
Figure 6:
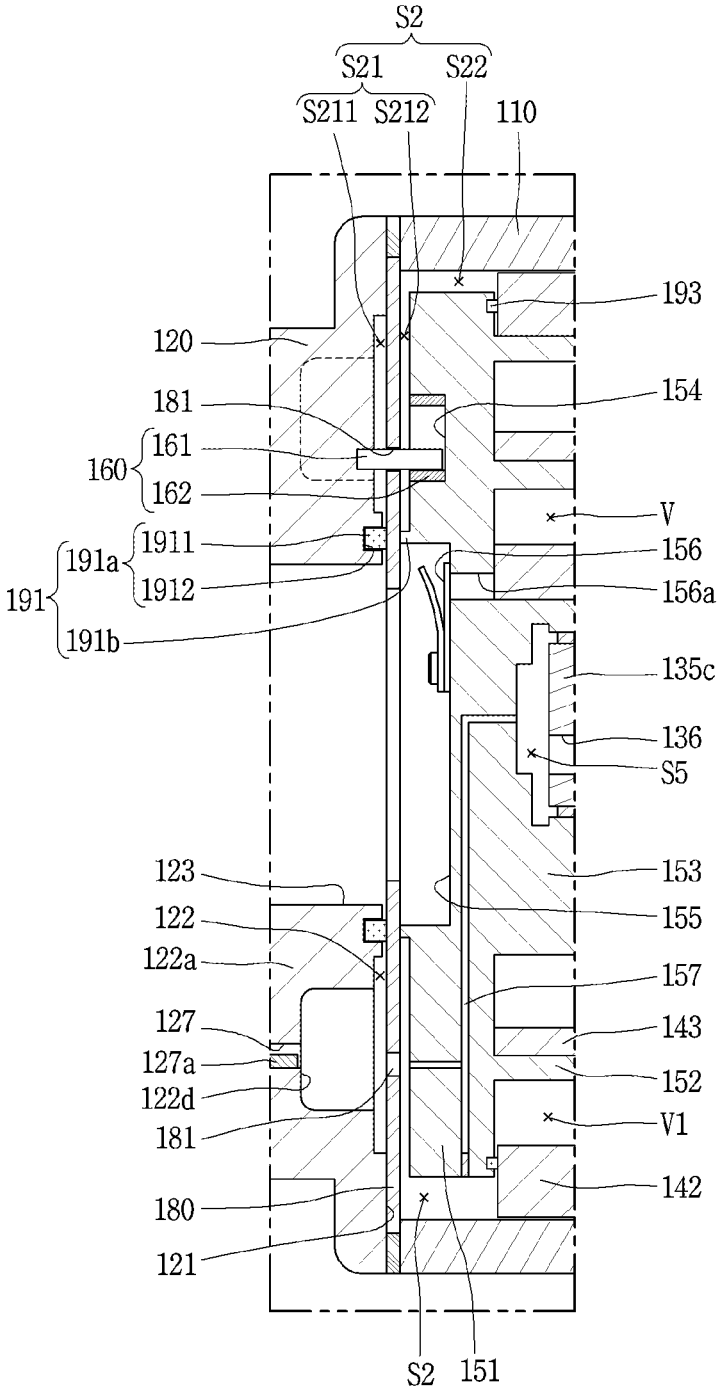
FIG. 6 is an assembled cross-sectional view showing the members in FIG. 5.
Figure 7:
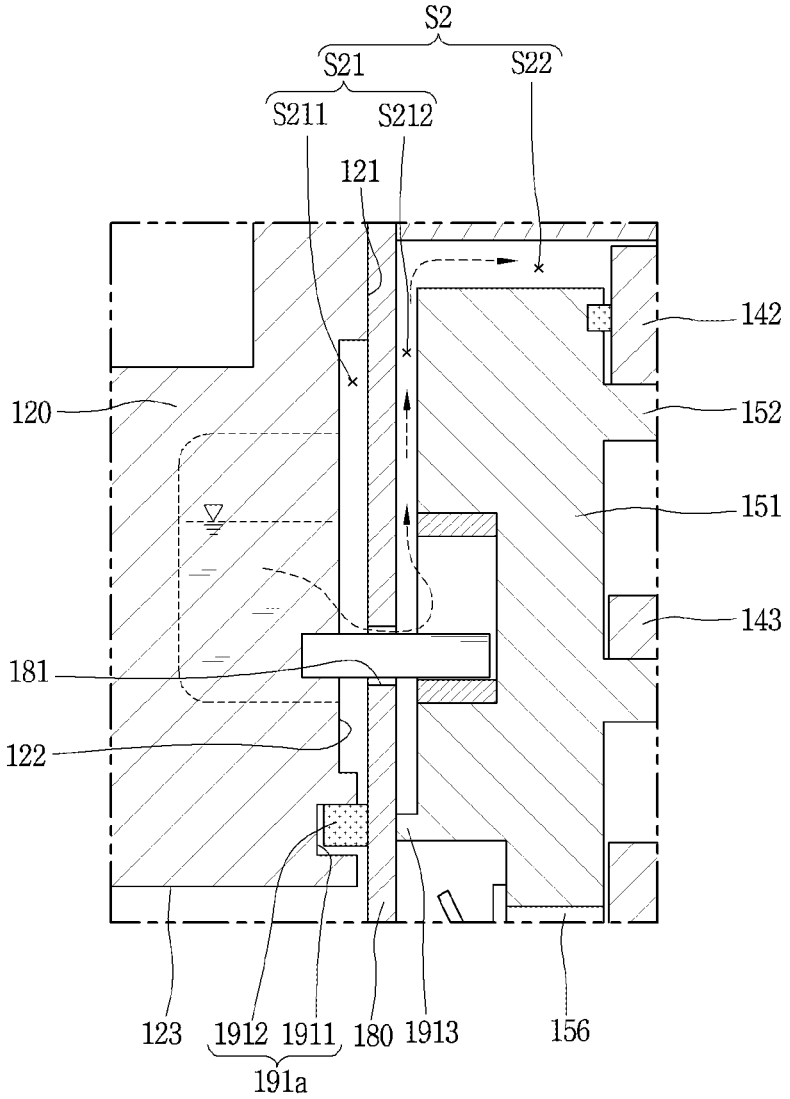
FIG. 7 is an enlarged sectional view showing the periphery of a back pressure chamber in FIG. 6.

FIG. 5 is an exploded perspective view showing members constituting a back pressure chamber in a motor operated compressor, and FIG. 6 is an assembled cross-sectional view showing the members in FIG. 5, and FIG. 7 is an enlarged sectional view showing the periphery of a back pressure chamber in FIG. 6.

The back pressure chamber (S2) according to the present embodiment is disposed between a front surface of the rear housing 120 and a rear surface of the orbiting scroll 150 and between an inner surface of the main housing 110 and an outer surface of the orbiting scroll 150, respectively. For convenience, a back pressure chamber disposed between the rear housing and the orbiting scroll and a back pressure chamber disposed between an inner surface of the main housing and an outer surface of the orbiting scroll will be described separately as a first intermediate pressure space (S21) and a the second intermediate pressure space (S22), respectively. The first intermediate pressure space (S21) and the second intermediate pressure space (S22) may be separately defined as a first region and a second region, respectively.

The first intermediate pressure space (S21) may be formed as a single space. However, when the support plate 180 is provided between the orbiting scroll 150 and the rear housing 120 as in the present embodiment, the first intermediate pressure space (S21) may be divided into a rear side first space (S211) and a front side first space (S212) around the support plate 180. The rear side first space (S211) is formed on a rear surface side of the support plate 180, and the front first space (S212) is formed on a front surface side of the support plate 180, respectively.

Since the rear side first space (S211) is formed between a rear surface of the support plate 180 and a front surface of the rear housing 120 facing the support plate 180, the support plate 180 and the rear housing 120 constituting the rear side first space (S211) will be first described.

Referring to FIG. 5, the support plate 180 according to the present embodiment is defined in an annular shape and provided between the rear housing 120 and the orbiting scroll 150. Accordingly, the support plate 180 may reduce friction loss and abrasion occurring between the rear housing 120 and the orbiting scroll 150 during the orbiting movement of the orbiting scroll 150. Therefore, it may be formed of a material having a wear resistance greater than that of the orbiting scroll 150 or the rear housing 120.

As described above, an outer circumference that is an edge of the support plate 180 is fixedly coupled between the main housing 110 and the rear housing 120, and an inner circumference that is the center thereof is located between the rear housing 120 and the orbiting scroll 150 in a free state. Accordingly, an outer diameter of the support plate 180 may be defined substantially the same as an inner diameter of the rear housing 120, and an inner diameter of the support plate 180 may be substantially the same as an inner diameter of the discharge pressure space portion 123 of the rear housing 120, which will be described later.

In addition, as described above, a plurality of pin holes 181 to which the anti-rotation pins 161 are coupled therethrough are arranged on the support plate 180. The plurality of pin holes 181 are disposed at predetermined intervals along the circumferential direction. an inner diameter of each pin hole 181 is defined substantially the same as or slightly larger than an outer diameter of each anti-rotation pin 161.

Here, when the inner diameter of each pin hole 181 is defined to be larger than the outer diameter of each anti-rotation pin 161, the rear side first space (S211) and the front side first space (S212) disposed on both sides of the support plate 180 through a gap between the pin hole 181 and the anti-rotation pin 180 may communicate with each other.

Furthermore, the oil communication hole 182 in addition to the pin hole 181 may be additionally defined on the support plate 180. The oil communication hole 182 may be located between the plurality of pin holes 181 or may be disposed on an outer or inner side than the pin holes 181.

On the other hand, referring to FIG. 5, the rear housing 120 according to the present embodiment is defined in a cap cross-sectional shape in which a front end thereof is open and a rear end thereof is closed. For example, the rear housing 120 may have the plate support portion 121, the intermediate pressure space portion 122, the discharge pressure space portion 123, and the oil separation space portion 124 sequentially arranged in order from the front side to the rear side.

The plate support part 121 is disposed to extend radially from an inner circumferential surface of the rear housing 120. The plate support portion 121 is disposed flat, and a rear edge of the support plate 180 is supported in an axial direction.

The intermediate pressure space portion 122 is disposed to extend from the inner side to the rear side of the plate support portion 121. The intermediate pressure space portion 122 defines the first intermediate pressure space (S21) together with the plate support portion 121.

The intermediate pressure space portion 122 may be disposed at the same height as the plate support portion 121. However, since the intermediate pressure space portion 122 is a space constituting a type of back pressure chamber, it is preferable to be recessed toward the rear side and lower than the height of the plate support portion 121. Accordingly, the support plate may generate a greater elastic force by a height difference between the plate support portion 121 and the intermediate pressure space portion 122.

The intermediate pressure space portion 122 may be disposed flat. However, the intermediate pressure space portion 122 may be disposed unevenly to be provided with a plurality of oil storage pockets 122*d* along the circumferential direction. For example, as shown in FIGS. 5 and 6, the intermediate pressure space portion 122 has a first annular support surface 122*a* on an outer circumferential side thereof and a second annular support surface 122*b* on an inner circumferential side thereof, respectively. The first annular support surface 122*a* and the second annular support surface 122*b* are respectively defined in an annular protrusion shape.

In addition, a connection rib 122*c* extending in a radial direction may be disposed between the first annular support surface 122*a* and the second annular support surface 122*b*. The connection ribs 122*c* may be disposed at predetermined intervals along the circumferential direction. Accordingly, the intermediate pressure space portion 122 is disposed with a plurality of oil storage pockets 122*d*, and the oil storage pockets 122*d* are filled with medium pressure oil moving from an oil separation chamber (S4) of the oil separation space portion 124 through an oil recovery hole 127, which will be described later.

The first annular support surface 122*a* may be disposed flat. For example, the first annular support surface 122*a* is disposed to be lower than the plate support portion 121, and the first annular support surface 122*a* is not provided with a separate sealing member. Accordingly, the first annular support surface 122*a* is spaced apart from the support plate 180 to define the rear side first space (S211) together with the oil storage pocket 122*d*.

The second annular support surface 122*b* may be formed flat as a whole similar to the first annular support surface 122*a*. However, a first sealing groove 1911 recessed in the axial direction may be disposed on the second annular support surface 122*b*. The first sealing groove 1911 is disposed at a position as close to the discharge pressure space 123 as possible. For example, the first sealing groove 1911 may be disposed at a position spaced apart by a predetermined distance from an inner circumferential edge of the intermediate pressure space portion 122, but may also be disposed at an inner circumferential edge of the intermediate pressure space portion 122.

FIGS. 5 and 6 illustrate an example in which the first sealing groove 1911 is disposed at an inner circumferential edge of the intermediate pressure space portion 122. In this case, the first sealing member 1912 constituting a housing-side sealing portion 191*a* is axially inserted into and coupled to the first sealing groove 1911. The first sealing member 1912 floats toward the support plate 180 due to a difference between a pressure of the discharge pressure space portion 123 and a pressure of the intermediate pressure space portion 122 to be brought into close contact with a rear surface of the support plate 180. Then, the intermediate pressure space portion 122 and the discharge pressure space portion 123 are sealed therebetween and an inner circumferential side of the rear side first space (S211) is sealed with respect to the support plate 180.

Here, an entire inner circumferential front surface of the support plate 180 may be sealed in close contact with a rear surface of the orbiting end plate portion 151. However, in this case, the first intermediate pressure space (S21) and the second intermediate pressure space (S22) described above are closed by the support plate 180. Then, refrigerant in the suction pressure chamber (V1) may be leaked as the second intermediate pressure space (S22) becomes a vacuum pressure.

In addition, when an entire inner circumferential front surface of the support plate 180 is brought into close contact with a rear surface of the orbiting end plate portion 151, most of the rear surface of the orbiting end plate portion 151 in contact with the supporting plate 180 must be precisely machined. Due to this, the processing cost may increase, and the actual sealing force may also be reduced due to a machining error.

Accordingly, an additional sealing member is provided or a sealing protrusion 1913 extending from a rear surface of the orbiting end plate portion 151 toward a front surface of the support plate 180 as described above may be disposed on a rear surface of the orbiting end plate portion 151.

The sealing protrusion 1913 constitutes a scroll-side sealing portion 1912, and defines the first sealing portion 191 that closes between the intermediate pressure space portion 122 and the discharge pressure space portion 123, which will be described later, together with the housing-side sealing portion 191*a* described above.

Referring to FIGS. 5 and 6, the sealing protrusion 1913 may be defined in an annular shape. Through this, the intermediate pressure space portion 122 is sealed against the discharge pressure space portion 123 to maintain the pressure of the intermediate pressure space portion 122.

In addition, the sealing protrusion 1913 may be disposed at a position where part thereof and the first sealing member 1912 overlap with each other in a radial direction during the orbiting movement of the orbiting scroll 150, for example, at an inner side than the pin hole 181 or the oil communication hole 182 of the support plate 180.

Through this, as shown in FIG. 7, a rear surface of the orbiting end plate portion 151 may be spaced from the support plate 180 to allow oil in the first intermediate pressure space (S21) to efficiently move to the second intermediate pressure space (S22) through the pin hole 181 or the oil communication hole 182. Then, the second intermediate pressure space (S22) is always in communication with the first intermediate pressure space (S21) to prevent the second intermediate pressure space (S22) from being evacuated.

As shown in FIG. 5, the connection rib 122*c* may be disposed to connect between the first annular support surface 122*a* and the second annular support surface 122*b*. Accordingly, it may be possible to physically reinforce the rear housing 120 as well as to evenly distribute the pressure of the intermediate pressure space 122.

Furthermore, the connection ribs 128*c* may be arranged at the same height or to be lower than the first annular support surface 122*a* and the second annular support surface 122*b* to allow a plurality of oil storage pockets 124*a* to communicate with each other.

In addition, pin grooves 128*e* may be provided in the connection ribs 128*c* to allow the anti-rotation pins 161 to be pressed thereinto. Accordingly, the connecting rib 128*c* may be disposed at an angle and position corresponding to the anti-rotation ring 162 inserted into the anti-rotation groove 154 of the orbiting scroll 150.

However, the anti-rotation pin 191 is not necessarily provided on the connecting rib 128*c*. In other words, when the anti-rotation pin 191 is coupled to the connection rib 122*c*, the position of the connection rib 128*c* is constrained to the position of the anti-rotation pin 191. Therefore, to increase a degree of freedom of the design for the connecting rib 128*c*, the anti-rotation pin 161 may be disposed on the first annular support surface 122*a* or a pin fixing protrusion (not shown) may be disposed in the oil storage pocket 122*d* between the connecting ribs 128*c* to install the anti-rotation pin 191.

Meanwhile, a discharge pressure space portion 123 is disposed at an inner side of the intermediate pressure space portion 122. The discharge pressure space portion 123 needs to accommodate refrigerant discharged from the compression chamber (V), and is disposed to be deeply recessed in an axial direction in the intermediate pressure space portion 122. For example, an axial height of the discharge pressure space portion 123 may be preferably disposed to be higher than that of the intermediate pressure space portion 122. In addition, an inner diameter of the discharge pressure space portion 123 may be defined substantially the same as that of the discharge guide groove 155 or that of the support plate 180.

Furthermore, the discharge pressure space portion 123 is disposed to face the discharge guide groove 156 of the orbiting scroll 150 described above to communicate with the discharge port 156. Accordingly, as shown in FIGS. 5 and 6, the center (Od) of the discharge pressure space portion 123 may be disposed eccentrically with respect to the center (Or) of the rear housing 120, similar to the discharge guide groove 156, that is, the shaft center (Oc) of the rotation shaft 135, and the housing-side sealing portion 191*a* may be disposed eccentrically with respect to the center (Or) of the rear housing 120. Due to this, the first intermediate pressure space (S21) is disposed eccentrically with respect to the shaft center (Oc). This also applies to the second intermediate pressure space (S22).

Referring to FIGS. 5 and 6, the discharge pressure space portion 123 is defined in a cylindrical shape in which a rear surface thereof is closed, and an oil separation space portion 124 is disposed on a rear surface of the discharge pressure space portion 124. The discharge pressure space portion 123 is provided with a discharge chamber (S3) communicating with the compression chamber (V), and an oil separation space portion 124 has an oil separation chamber (S4) communicating with the discharge chamber (S3).

Therefore, a rear surface of the discharge pressure space portion 123 may be disposed to protrude slightly convex toward the front side to secure the oil separation space portion 124. An oil separation communication hole 122*a* is disposed on a rear surface of the discharge pressure space portion 123 to communicate with the oil separation space portion 124.

The oil separation space portion 124 is disposed in a vertical direction or in a direction slightly inclined with respect to the vertical direction. An oil separator 123*a* is provided in the oil separation space portion 124 to separate oil from refrigerant flowing into the oil separation space portion 124. The oil-separated refrigerant moves to a refrigeration cycle through the exhaust port 126 penetrated at an upper end of the oil separation space portion 124, while oil in a mist state separated from the refrigerant moves to the intermediate pressure space portion 122 through the oil recovery hole 127 penetrated at a lower end of the oil separation space portion 124.

Here, the oil recovery hole 127 may be disposed through a rear wall surface of the oil storage pocket 122*d*. However, as shown in FIG. 5, an oil recovery protrusion 122*e* protruding from the relevant oil storage pocket 122*d* may be disposed, and the oil recovery hole 127 may be disposed inside the oil recovery protrusion 122*e*. The rigidity of the rear housing 120 may also be reinforced through the oil recovery protrusion 122*e*. The oil recovery protrusion 122*e* is disposed to have a height approximately equal to that of the connection rib 128*c*.

Referring to FIG. 6, a flow control unit 127*a* may be provided in the oil recovery hole 127. The flow control unit 127*a* adjusts a flow amount of oil passing through the oil recovery hole 127 to perform the role of reducing the pressure to an intermediate pressure when high-pressure oil separated from the oil separation space portion 124 flows into the intermediate pressure space portion 122.

Therefore, the flow control unit 127*a* may be composed of a decompression member such as a decompression pin or decompression rod having an outer diameter smaller than an inner diameter of the oil recovery hole 127. The flow control unit may be provided in the oil guide passage of the orbiting scroll 150, which will be described later, or may be provided in the oil supply passage of the rotation shaft 135.

In this way, part of oil flowing into the rear side first space (S211) through the oil recovery hole 127 moves from the rear side first space (S211) to the front side first space (S212) through the pin hole 181 or the oil communication hole 182 of the support plate 180.

Then, the entire first intermediate pressure space (S21) is filled with oil or refrigerant constituting an intermediate pressure, and part of the refrigerant or oil moves to the second intermediate space (S22) through a gap between the rear housing 120 and the orbiting scroll 150.

Then, the entire first intermediate pressure space (S21) and second intermediate pressure space (S22) are filled with medium-pressure oil (or refrigerant oil in a mist state).

Figure 8:
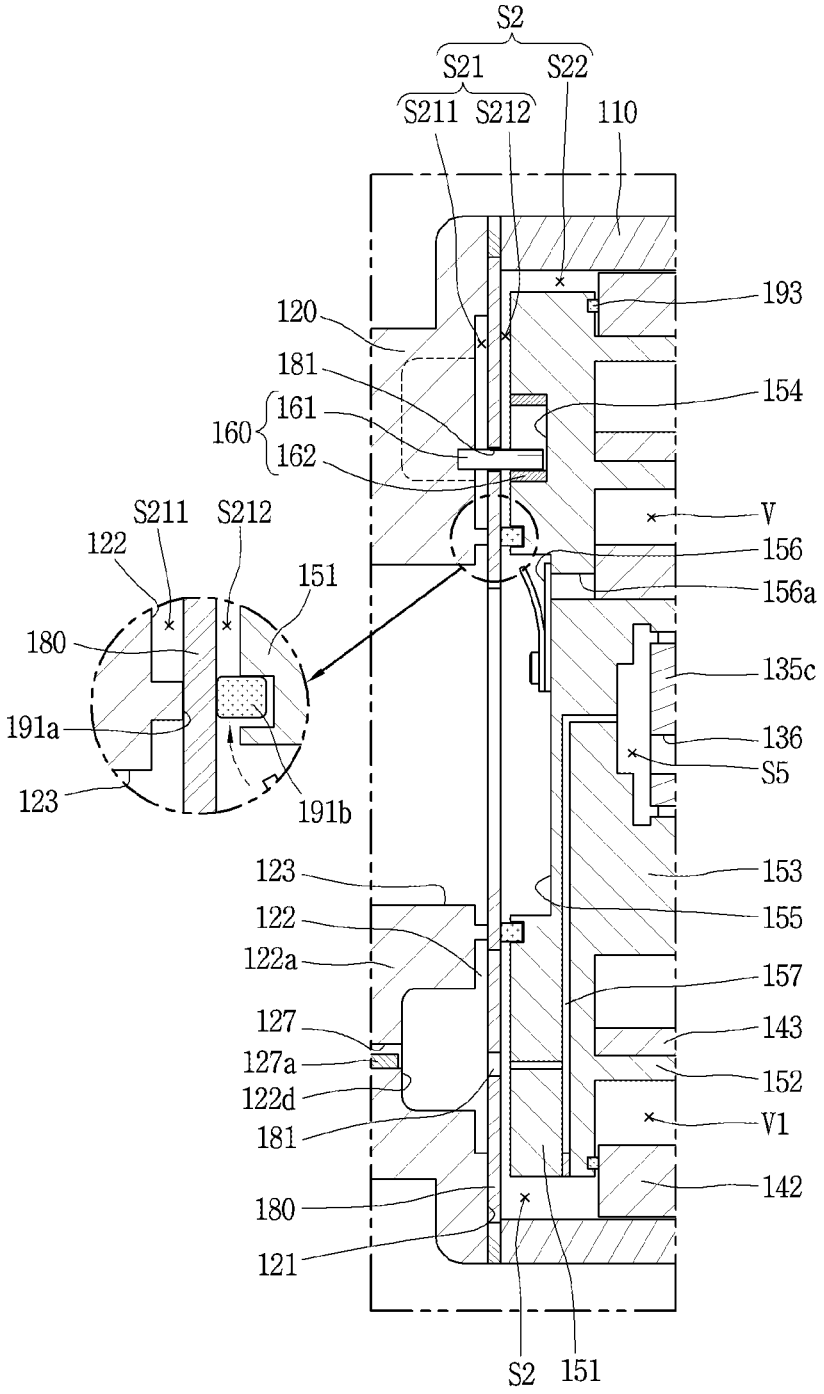
FIG. 8 is a cross-sectional view showing another embodiment of a first sealing portion.

Meanwhile, another embodiment of the first sealing portion will be described as follows. FIG. 8 is a cross-sectional view showing another embodiment of a first sealing portion.

In other words, the housing-side sealing portion 191*a* in the foregoing embodiment has a structure in which the first sealing member 1912 is movably inserted into the first sealing groove 1911 in an axial direction, and the scroll-side sealing portion 1912 is disposed such that the sealing protrusion 1913 extends to protrude toward a front surface of the support plate 180 on a rear surface of the orbiting end plate portion 151.

Accordingly, the housing-side sealing portion 191*a* in the foregoing embodiment seals between the intermediate pressure space portion 122 and the discharge pressure space portion 123 disposed at a rear side of the support plate 180 while the first sealing member 1912 moves axially inside the first sealing groove 1911, and the scroll-side sealing portion 1912 seals between the intermediate pressure space portion 122 and the discharge pressure space portion 123 disposed at a front side of the support plate 180 while being brought into close contact with a front side of the support plate 180.

However, as shown in FIG. 8, the housing-side sealing portion 191*a* according to the present embodiment may be composed of a sealing protrusion, and the scroll-side sealing portion 1912 may be composed of a sealing groove and a sealing member. The configuration of the housing-side sealing portion 191*a* and the scroll-side sealing portion 1912 is opposite to each other compared to the foregoing embodiment, and the effect thereof is substantially the same.

However, in this case, it may be possible to facilitate the machining of the orbiting scroll 150 requiring relatively complicated machining. Furthermore, when assembling the rear housing 120, the sealing member may be prevented from being removed, thereby facilitating assembly.

In addition, although not shown in the drawings, both the housing-side sealing portion 191*a* and the scroll-side sealing portion 1912 may be configured with sealing protrusions, and, on the contrary, both sealing portions 191*a*, 1912 may be configured with sealing grooves and sealing members.

Figure 9:
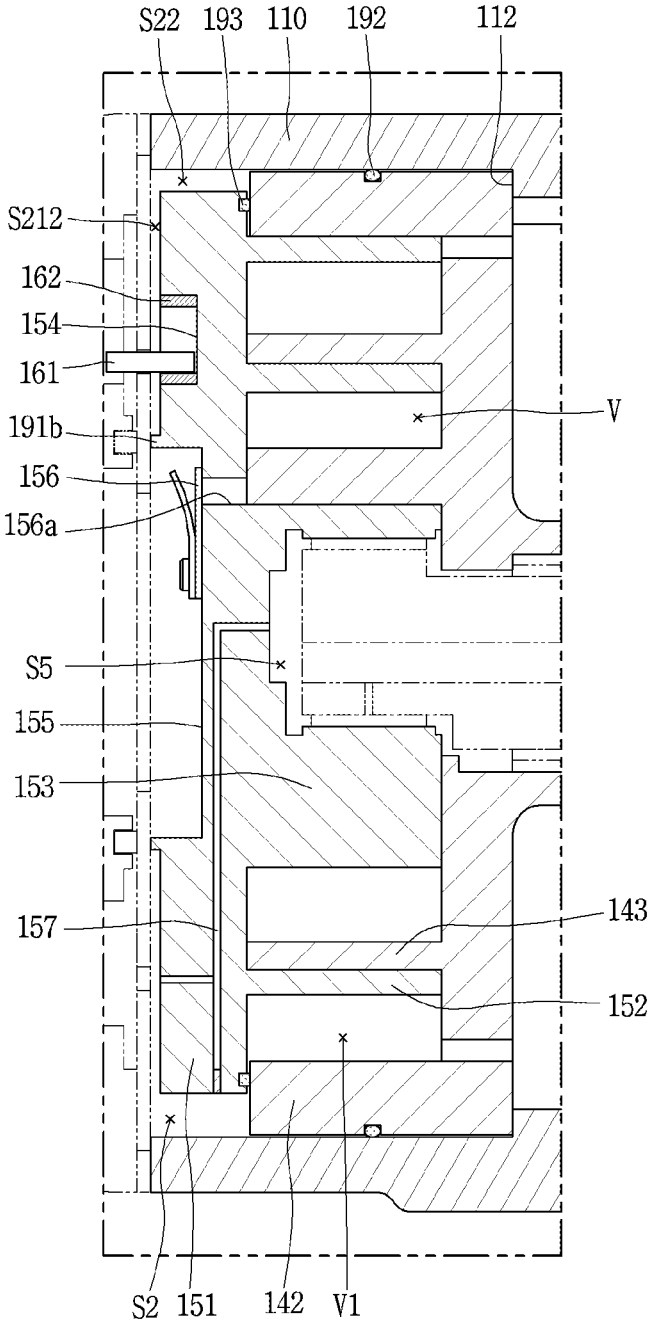
FIG. 9 is a cross-sectional view showing a fixed scroll and an orbiting scroll forming a second intermediate pressure space.

Next, the second intermediate pressure space (S22) will be described. FIG. 9 is a cross-sectional view showing a fixed scroll and an orbiting scroll forming a second intermediate pressure space.

Referring to FIG. 9, the second intermediate pressure space (S22) according to the present embodiment is disposed between an outer circumferential surface of the orbiting end plate portion 151 and an inner circumferential surface of the main housing 110 facing the same as described above, and the second intermediate pressure space (322) communicates with the first medium pressure space (S21).

To this end, a sealing member is not provided between the first intermediate pressure space (S21) and the second intermediate pressure space (S22). Specifically, as the sealing protrusion is disposed on a rear surface of the orbiting scroll 150, the support plate 180 is spaced apart from the orbiting scroll 150 such that the rear side first space (S211) communicates with the front side first space (S212), and the orbiting end plate portion 151 is spaced apart from the rear housing 120 such that the front side first space (S212) communicates with the second intermediate pressure space (S22).

Here, though the second intermediate pressure space (S22) communicates with the first intermediate pressure space (S21), the suction space (motor chamber) (S1) and the compression chamber (more precisely, the suction pressure chamber) (V) should be closed respectively. That way, the second intermediate pressure space (S22) may maintain an intermediate pressure.

The second intermediate pressure space (S22) and the motor chamber (S1) are provided with a second sealing portion 192 between the main housing 110 and the fixed scroll 140 to close (seal) between the second intermediate pressure space (S22) and the motor.

Referring to FIG. 9, the main housing 110 has a scroll support surface 112 disposed in a stepped manner on a rear inner circumferential surface thereof. On the scroll support surface 112, the fixed end plate portion 141 of the fixed scroll 140 is supported in an axial direction. The scroll support surface 112 may be disposed in an arc-shaped stepped manner or an annular shaped stepped manner.

However, in the present embodiment, since the motor chamber (S1) constituting a suction pressure space and the back pressure chamber (S2) constituting an intermediate pressure space is separated from each other in an inner space of the main housing 110 around the fixed scroll 140, the scroll support surface 112 may be defined in an annular shape to increase a contact area with the fixed end plate portion 141 so as to enhance the sealing effect.

In addition, on the scroll support surface 112 of the main housing 110, as described above, as the fixed end plate portion 141 is mounted thereon, if possible, the larger the radial width of the scroll support surface 112, the more advantageous in terms of reliability. However, as the suction port 145 is disposed at an edge of the fixed end plate portion 141, the scroll support surface 112 is preferably disposed to have a radial width so as not to interfere with the suction port 145.

The sidewall portion 142 of the fixed scroll 140 is disposed to have an outer diameter approximately similar to an inner diameter of the main housing 110. For example, when the outer diameter of the sidewall portion 142 is formed to be the same as (or slightly larger than) the inner diameter of the main housing 110, the fixed scroll 140 may be fixed only by the main housing 110. However, when the outer diameter of the sidewall portion 142 is smaller than the inner diameter of the main housing 110, the fixed scroll 140 may be fixed by the main housing 110 and the rear housing 120.

When the outer diameter of the fixed scroll 140 is formed to be the same as (or slightly larger than) the inner diameter of the main housing 110, an outer circumferential surface of the sidewall portion 142 is brought into close contact with the inner circumferential surface of the main housing 110. Then, the motor chamber (S1) and the back pressure chamber (S2) are separated by the fixed scroll 140.

However, when the outer diameter of the fixed scroll 140 is formed to be smaller than the inner diameter of the main housing 110, an outer circumferential surface of the sidewall portion 142 may be spaced apart from an inner circumferential surface of the main housing 110. Then, the motor chamber (S1) and the back pressure chamber (S2) are not separated by the fixed scroll 140. In this case, the second sealing portion 192 may be provided between an outer circumferential surface of the fixed scroll 140 and an inner circumferential surface of the main housing 110.

Figure 10:
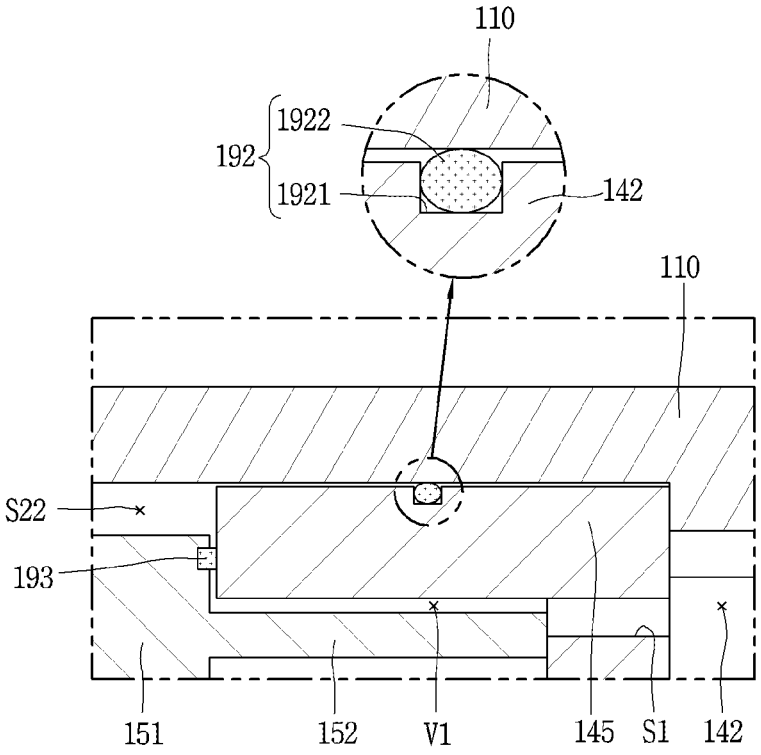
FIG. 10 is an enlarged cross-sectional view showing an embodiment of a second sealing portion.

FIG. 10 is an enlarged cross-sectional view showing an embodiment of a second sealing portion.

Referring to FIG. 10, the second sealing portion 192 may include a second sealing groove 1921 disposed on an outer circumferential surface of the fixed scroll 140, that is, an outer circumferential surface of the sidewall portion 142, and a second sealing member 1922 inserted into the second sealing groove 1921.

The second sealing groove 1921 and the second sealing member 1922 may respectively be defined in an annular shape and coupled to each other. For example, the second sealing member 1922 may be composed of a sealing member having an annular shape with an elastic force, such as a type of O-ring, and inserted into and fixed to the second sealing groove 1921 defined in an annular shape.

Then, even when an outer diameter of the fixed scroll 140 is formed smaller than an inner diameter of the main housing 110 to generate a gap between an outer circumferential surface of the fixed scroll 140 and an inner circumferential surface of the main housing 110, the motor chamber and the back pressure chamber may be separated by the second sealing member 1922. This may be applicable even when the outer diameter of the fixed scroll 140 and the inner diameter of the main housing 110 are defined to be the same (or slightly larger).

As illustrated in FIG. 10, the second sealing member 1922 may be defined in a rectangular cross-sectional shape and brought into close contact with an inner circumferential surface of the main housing 110 while floating by a pressure difference between the back pressure chamber (S2) and the motor chamber (S1).

Furthermore, although not illustrated in the drawing, the second sealing member may be defined to have a U-shaped cross-section so as to be brought into close contact with an inner circumferential surface of the main housing while being opened by a pressure of the back pressure chamber.

In addition, although not illustrated in the drawing, the second sealing groove may be disposed on an inner circumferential surface of the main housing, and the second sealing member may be inserted into the second sealing groove of the main housing.

Figure 11:
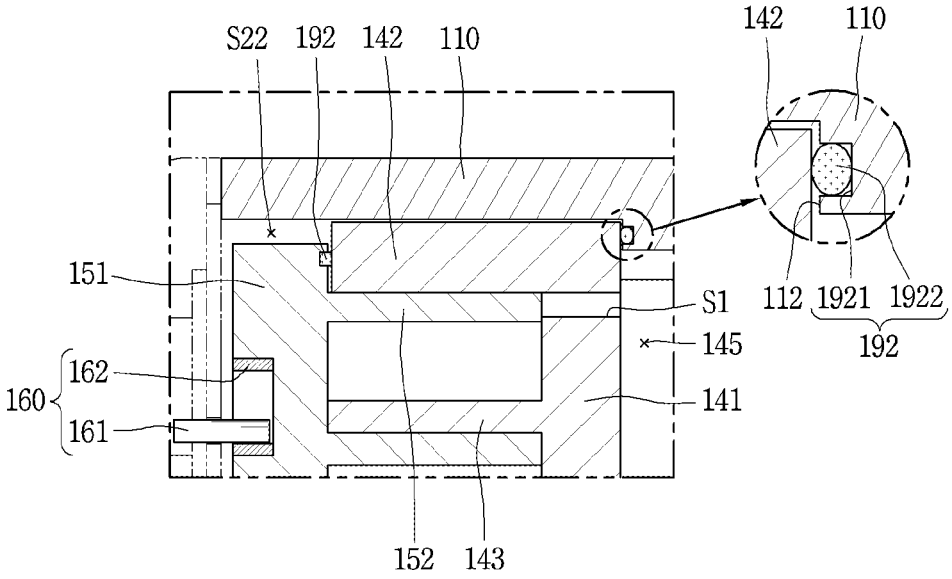
FIG. 11 is a cross-sectional view showing another embodiment of the installation position of the second sealing portion.

Meanwhile, the second sealing portion 192 according to the present disclosure may be disposed between a front surface of the fixed end plate portion 141 and the scroll support surface 112 of the main housing 110 facing the same. FIG. 11 is a cross-sectional view showing another embodiment of the installation position of the second sealing portion.

Referring to FIG. 11, the second sealing groove 1921 in an annular shape may be disposed on the scroll support surface 112, and the second sealing member 1922 may be inserted into the second sealing groove 1921. The second sealing member 1922 may be defined in an O-ring shape as in the foregoing embodiment, or may be defined in a rectangular cross-sectional shape or a U-shaped cross-sectional shape.

Meanwhile, the second sealing portion 192 according to the present embodiment may be provided between an outer circumferential surface of the fixed scroll 140 and an inner circumferential surface of the rear housing 120.

In other words, a rim of the rear housing 120 extends in an axial direction to define a scroll receiving portion (not shown), and the second sealing groove 1921 may be disposed on an outer circumferential surface of the fixed scroll 140 facing an inner circumferential surface of the scroll receiving portion (not shown), and the second sealing member 1922 may be inserted into and coupled to the second sealing groove 1921.

The second sealing member 1922 may be defined in an O-ring shape as in the foregoing embodiment, or may be defined in a rectangular cross-sectional shape or a U-shaped cross-sectional shape.

As described above, even when the second sealing portion 192 is disposed between the scroll support surface 112 and a front surface of the fixed end plate portion 141 facing the same, the motor chamber (S1) constituting a suction pressure space and the back pressure chamber (S2) constituting an intermediate pressure space may be separated therebetween.

However, as the suction port 145 is disposed in the fixed end plate portion 141 of the fixed scroll 140, refrigerant or oil in the back pressure chamber (S2) constituting an intermediate pressure space may leak into an inner space of the main housing 110 through the suction port 145. In other words, in case where the suction pressure chamber (V1) and the back pressure chamber (S2) are not closed even when the sidewall portion 142 of the fixed scroll 140 and an inner circumferential surface of the main housing 110 or the rear housing 120 facing the same are closed by the second sealing portion 192, refrigerant in the back pressure chamber (S2) may move to the suction pressure chamber (V1) and then leak into an inner space of the main housing 110 through the suction port 145.

Therefore, a third sealing portion 193 may be provided between the back pressure chamber (S2) constituting an intermediate pressure space portion 122 and the suction pressure chamber (V1) constituting the compression chamber (V) to close between the back pressure chamber (S2) and the pressure chamber (V1).

Figure 12:
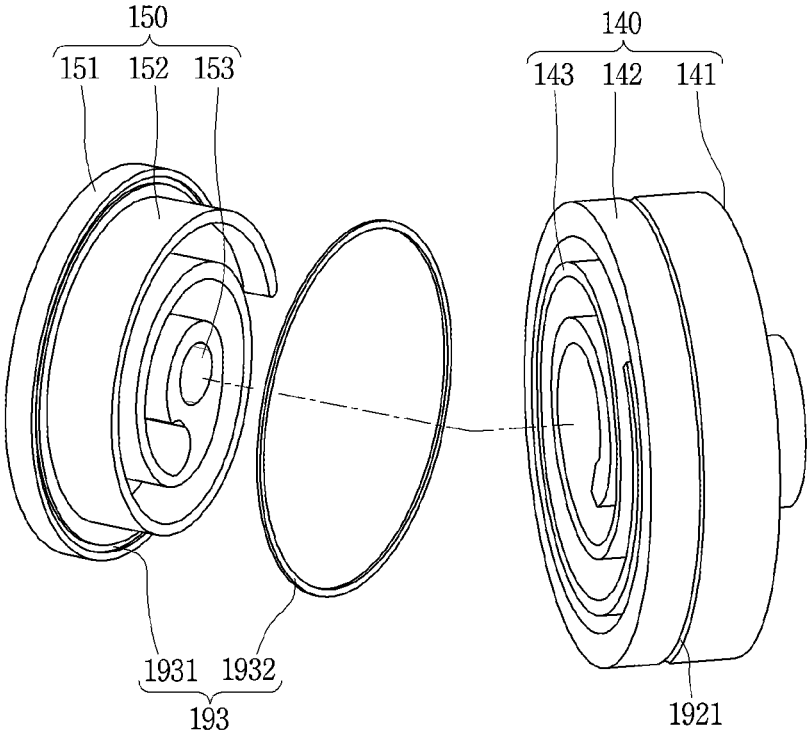
FIG. 12 is an exploded perspective view showing a fixed scroll and an orbiting scroll for explaining a third sealing portion.
Figure 13:
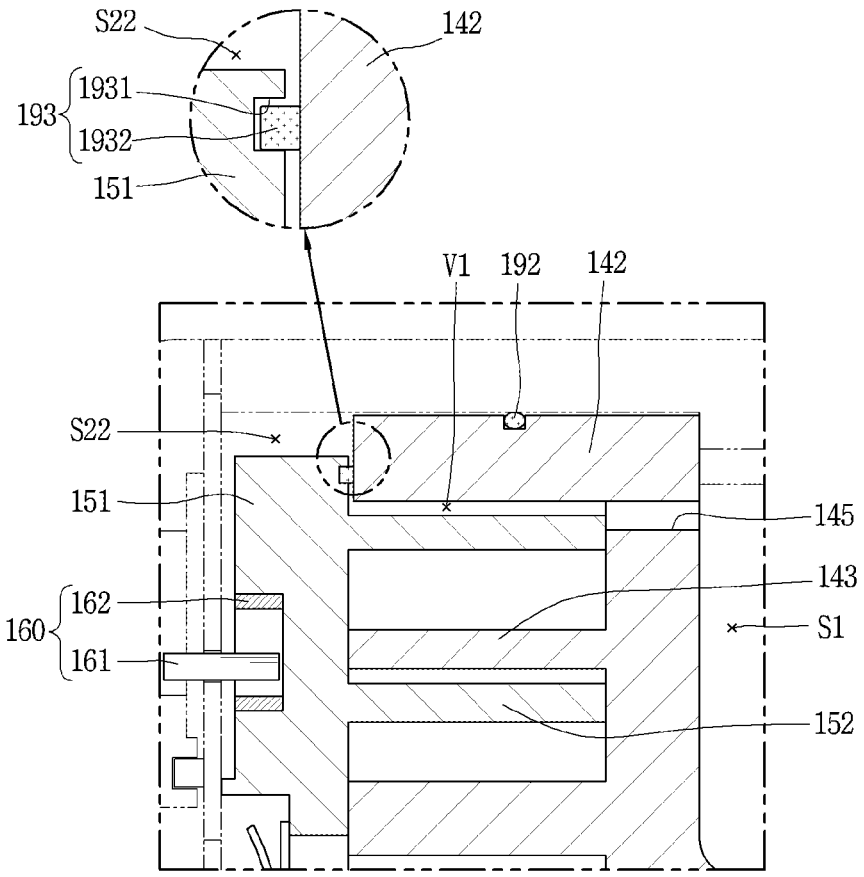
FIG. 13 is an assembled cross-sectional view showing part of the fixed scroll and the orbiting scroll in FIG. 12.

FIG. 12 is an exploded perspective view showing a fixed scroll and an orbiting scroll for explaining a third sealing portion, and FIG. 13 is an assembled cross-sectional view showing part of the fixed scroll and the orbiting scroll in FIG. 12.

Referring to FIGS. 12 and 13, the third sealing portion 193 according to the present embodiment may include a third sealing groove 1931 provided on an axial bearing surface between the fixed scroll 140 and the orbiting scroll 150, and a third sealing member 1932 slidably inserted into the third sealing groove 1931.

The third sealing groove 1931 may be disposed on a front surface of the orbiting end plate portion 151 constituting a thrust bearing surface together with the sidewall portion 142 of the fixed scroll 140.

Since the third sealing member performs a sliding movement with respect to the sidewall portion 142 of the fixed scroll 140, the third sealing member may be preferably formed of a material having lubricity as the first sealing member 1912.

As described above, the third sealing member 1932 according to the present embodiment is defined in an annular shape, and brought into close contact with the sidewall portion 142 of the fixed scroll 140 while floating by a pressure difference between the second intermediate pressure space (S22) and the suction pressure chamber (V1). Then, oil or refrigerant oil in the second intermediate pressure space (S22) constituting the back pressure chamber (S2) may be suppressed from being leaked into the suction pressure chamber (V1) while the second intermediate pressure space (S22) is closed with respect to the suction pressure chamber (V1).

Although not shown in the drawing, the third sealing groove 1931 may be disposed on a rear surface of the sidewall portion 142 of the fixed scroll 140. Even in this case, the basic structure and the effect thereof is the same as the foregoing embodiment.

Figure 14:
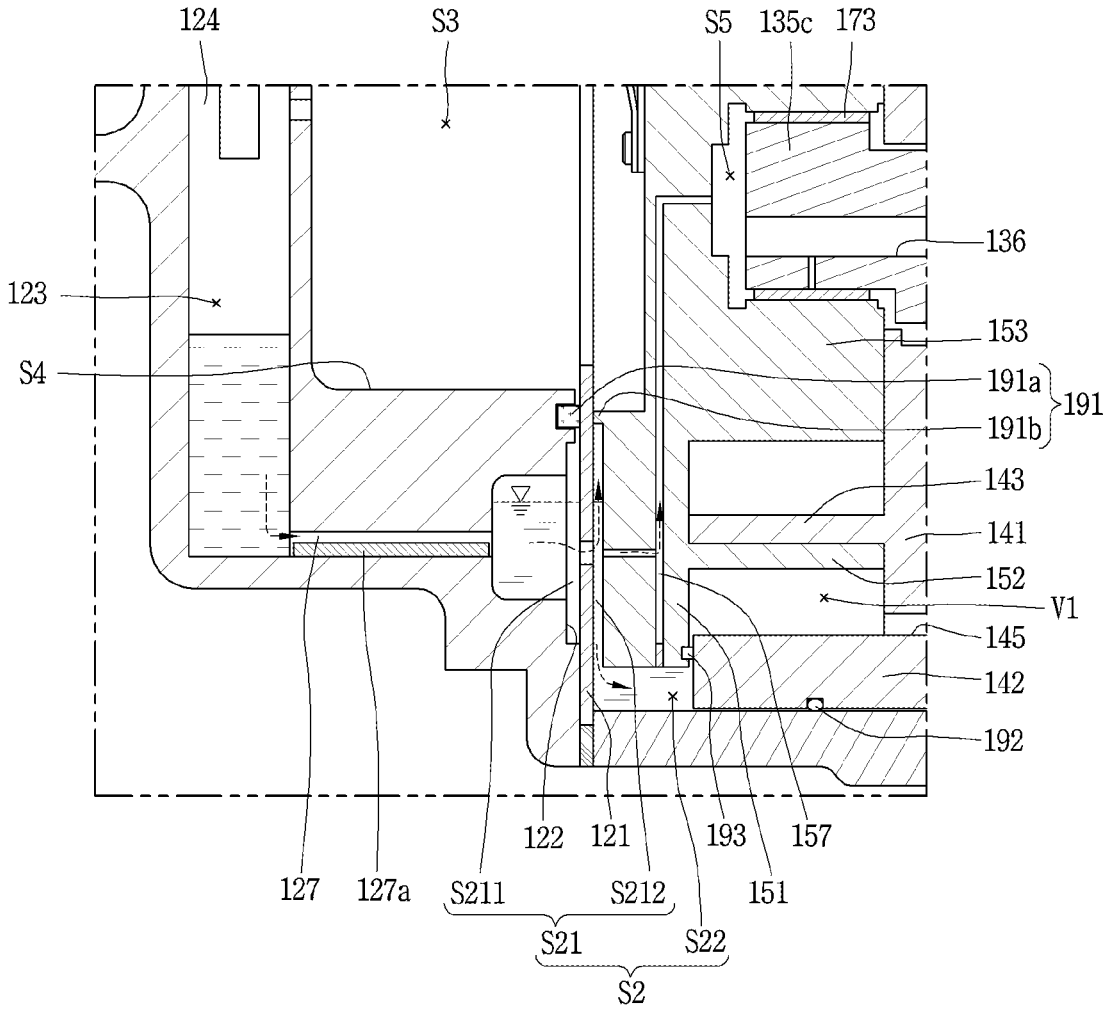
FIG. 14 is a cross-sectional view showing part of a compression unit for explaining an oil feeding structure in a motor operated compressor.

Next, an oil feeding structure will be described. FIG. 14 is a cross-sectional view showing part of a compression unit for explaining an oil feeding structure in a motor operated compressor.

Referring to FIG. 14, an oil feeding structure according to the present embodiment includes an oil recovery hole 127 of the rear housing 120 constituting a first passage, and an oil communication hole 182 of the support plate 180 constituting a second passage, an oil guide passage 157 of the orbiting scroll 150 constituting a third passage, and an oil supply passage 136 of the rotation shaft 135 constituting a fourth passage.

Here, the oil recovery hole 127 connects between an oil separation space portion and the intermediate pressure space portion 122 of the rear housing 120, and the oil communication hole 182 connects between the rear side first space (S211) and the front side first space (S212), and the oil guide passage 157 connects between the first intermediate pressure space (321) and an inner space of the rotation shaft coupling portion 153, and the oil supply passage 136 connects between an internal space of the rotation shaft coupling portion and each bearing surface.

The oil recovery hole 127 is disposed through between the intermediate pressure space portion 122 and the oil separation space portion 124 of the rear housing 120. For example, an annular partition wall protrusion 120*a* may be disposed on an inner circumferential surface of the rear housing 120. Then, the plate support portion 121 and the intermediate pressure space portion 122 may be disposed on a front side of the partition wall portion 120*a* around the partition wall protrusion 120*a*, and the discharge pressure space portion 123 may be disposed on an inner circumferential surface of the partition wall protrusion 120*a*, and the oil separation space portion 124 may be formed on a rear side of the partition wall protrusion 120*a*. The oil recovery hole 127 may be disposed through a lower half portion of the partition wall protrusion 120*a* in an axial direction.

The oil communication hole 182 is disposed through the support plate 180 in an axial direction. An inlet of the oil communication hole 182 communicates with the rear side first space (S211) and an outlet thereof with the front side first space (S212), respectively.

The oil guide passage 157 is disposed to pass from a rear surface of the orbiting end plate portion 151 to a front surface thereof. The oil guide passage 157 may be composed of first, second, and third guide passages 157*a*, 157*b*, 157*c* that are bent in direction from a rear surface of the orbiting end plate portion 151 to a front surface thereof. The first guide passage 157*a* may be disposed on an outer periphery of the orbiting end plate portion 151, and the third guide passage 157*c* at the center of the orbiting end plate portion 151 in an axial direction, respectively, and the second guide passage 157*b* may be disposed in a radial direction.

The oil supply passage 136 may be disposed to pass from a rear end surface of the rotation shaft 135*a* to an outer peripheral surface of the eccentric portion 135*c* and the main bearing portion 135*a*.

Accordingly, oil separated from the oil separation space portion 124 of the rear housing 120 moves to the intermediate pressure space portion 122 through the oil recovery hole 127, and the oil moves to the oil storage space S5 provided inside the rotation shaft coupling portion 153 through the oil communication hole 182 of the support plate 180 and the oil guide passage 157 of the orbiting scroll 150. The oil moves to each bearing surface and the compression chamber through the oil supply passage 136 of the rotation shaft 135.

At this time, the oil recovery hole 127 is provided with a flow control unit 127*a*, such as a decompression pin, to reduce the pressure of the oil moving from the oil separation space portion 124 to the intermediate pressure space portion 122 from a discharge pressure to an intermediate pressure. Then, the oil decompressed to the intermediate pressure moves to the rear side first space (S211) of the first intermediate pressure space (S21) constituting the back pressure chamber (S2).

Here, the oil moved to the rear side first space (S211) moves to the front side first space (S212) through the pin hole 181 or the oil communication hole 182 of the support plate 180. At this time, the first intermediate pressure space (321) has an outer diameter larger than that of the orbiting end plate portion 151. In particular, an additional sealing member is not provided on an outer edge side of the front side first space (S212) to be in direct communication with the second intermediate pressure space (322) provided on an outer circumferential surface of the orbiting end plate portion 151. Accordingly, an entire rear surface of the orbiting end plate portion 151 is included in the second intermediate pressure space (S22), and the entire rear surface of the orbiting end plate portion 151 is supported in an axial direction by oil filled in the second intermediate pressure space (S22) constituting the back pressure chamber (S2). Then, a back pressure area of the back pressure chamber (S2) supporting a rear surface of the orbiting scroll 150 may be secured to be wide to stably support the orbiting scroll 150 to that extent.

In this way, in a horizontal motor operated compressor to which a frame scroll is applied, a discharge pressure and an intermediate pressure may act on the orbiting scroll, thereby reducing the number of sealing members while effectively sealing the compression chamber. Through this, the number of sealing members that seal the compression chamber may be minimized, thereby reducing the manufacturing cost of the compressor.

Furthermore, in a horizontal motor operated compressor to which a frame scroll is applied, it may be possible to efficiently supply oil separated from refrigerant to the bearing surface while simplifying the oil feeding structure.

In addition, in a horizontal motor operated compressor to which a frame scroll is applied, the orbiting scroll may be secured to have an increased back pressure area to the frame scroll to stably support the orbiting scroll, thereby stabilizing the behavior of the orbiting scroll to effectively suppress the leakage of the compression chamber.

What is claimed is:

1. A motor operated compressor, comprising:

a main housing;

a rear housing coupled to the main housing and comprising a first space;

an electric motor unit disposed in an inner space of the main housing;

a rotation shaft coupled to the electric motor unit and being configured to rotate;

a fixed scroll disposed in the inner space of the main housing, the fixed scroll comprising a fixed end plate portion and a fixed wrap disposed on a side surface of the fixed end plate portion;

an orbiting scroll disposed between the fixed scroll and the rear housing, the orbiting scroll comprising an orbiting end plate portion and an orbiting wrap disposed on a side of the orbiting end plate portion, the orbiting wrap being configured to:

engage with the fixed wrap to form a compression chamber having a discharge side in fluid communication with the first space, and perform an orbiting movement with respect to the fixed scroll; and a first sealing portion configured to surround the first space to form a second space on an outer edge of the first space, wherein the second space comprises:

a first region disposed between an axial side surface of the orbiting end plate portion and the rear housing; and a second region disposed between an outer circumferential surface of the orbiting end plate portion and an inner circumferential surface of the fixed scroll, wherein the first region is in fluid communication with the second region, and wherein the rear housing further comprises:

an intermediate pressure space portion having a predetermined depth from an opening side end surface facing the main housing to form the second space;

a discharge pressure space portion having a predetermined depth from the intermediate pressure space portion, wherein the first sealing portion is disposed between the discharge pressure space portion and the intermediate space portion to form the first space;

an annular protrusion disposed between the intermediate pressure space portion and the discharge pressure space portion;

a sealing member disposed in the annual protrusion;

an oil separation space portion in fluid communication with the discharge pressure space portion and comprising an exhaust port on one side; and a first passage configured to provide fluid communication between the oil separation space portion and the intermediate pressure space portion.

2. The motor operated compressor of claim 1, further comprising:

a second sealing portion disposed between the fixed scroll and at least one of the main housing or the rear housing to separate the second space from the inner space of the main housing.

3. The motor operated compressor of claim 1, wherein the fixed end plate portion comprises a sidewall portion disposed on an outer edge of the fixed wrap, and the motor operated compressor further comprises a third sealing portion disposed between an end surface of the sidewall portion and a side surface of the orbiting end plate portion to separate the second space from the compression chamber.

4. The motor operated compressor of claim 3, wherein the fixed end plate portion comprises a suction port configured to provide fluid communication between the inner space of the main housing to the compression chamber, and the third sealing portion is located closer to an outer edge than the suction port in a radial direction.

5. The motor operated compressor of claim 4, wherein the third sealing portion comprises:

a third sealing groove disposed on at least one of an end surface of the sidewall portion or a side surface of the orbiting end plate portion facing the sidewall portion, and an additional sealing member inserted into the third sealing groove and configured to float based on a pressure of the second space.

6. The motor operated compressor of claim 1, further comprising an annular support plate disposed between the orbiting scroll and the rear housing;

wherein the first sealing portion comprises:

a housing-side sealing portion disposed between the rear housing and a first side surface of the support plate facing the rear housing, and a scroll-side sealing portion disposed between the orbiting scroll and a second side surface of the support plate facing the orbiting scroll.

7. The motor operated compressor of claim 6, wherein at least one of the housing-side sealing portion or the scroll-side sealing portion comprises:

a first sealing groove disposed in at least one of the rear housing or the orbiting scroll, and an additional sealing member inserted into the first sealing groove and configured to float toward the support plate based on a pressure difference between the first space and the second space.

8. The motor operated compressor of claim 6, wherein at least one of the housing-side sealing portion or the scroll-side sealing portion comprises:

a sealing protrusion extending from at least one of the rear housing or the orbiting scroll toward the support plate.

9. The motor operated compressor of claim 6, wherein at least part of the housing-side sealing portion and the scroll-side sealing portion are configured to overlap in a radial direction.

10. The motor operated compressor of claim 1, wherein the first sealing portion comprises:

a first sealing groove disposed in at least one of the rear housing or the orbiting scroll, wherein the first sealing member is inserted into the first sealing groove and is configured to float toward an opposite member based on a pressure difference between the first space and the second space.

11. The motor operated compressor of claim 1, wherein the second sealing portion comprises:

a second sealing groove disposed on at least one of an outer surface of the fixed scroll and an inner surface of the main housing, or a portion of the rear housing facing the outer surface of the fixed scroll, and a second sealing member inserted into the second sealing groove and configured to be brought into close contact with the outer surface of the fixed scroll and the inner surface of the main housing, or the portion of the rear housing facing the outer surface of the fixed scroll.

12. The motor operated compressor of claim 1, wherein the first passage is disposed closer to at an outer edge than the first sealing portion in a radial direction, and wherein the motor operated compressor further comprises a decompression portion is disposed in the first passage.

13. The motor operated compressor of claim 12, further comprising:

a support plate disposed between the rear housing and the orbiting scroll, the support plate comprising a second passage in fluid communication with the first passage, and a third passage disposed in the orbiting scroll in fluid communication with the second passage, the third passage being disposed on the orbiting end plate portion in fluid communication with an inner space of a rotation shaft coupling portion coupled to the rotation shaft.

14. The motor operated compressor of claim 13, wherein an end portion of the rotation shaft coupled to the rotation shaft coupling portion comprises a fourth passage passing from an end surface of the end portion to an outer circumferential surface of the rotation shaft.

15. A motor operated compressor, comprising:

a housing comprising a first space;

a fixed scroll disposed within the housing, the fixed scroll comprising a fixed end plate portion and a fixed wrap disposed on a side surface of the fixed end plate portion;

an orbiting scroll disposed between the fixed scroll and the housing, the orbiting scroll comprising an orbiting end plate portion and an orbiting wrap disposed on a side of the orbiting end plate portion, the orbiting wrap being configured to:

engage with the fixed wrap to form a compression chamber having a discharge side in fluid communication with the first space, and perform an orbiting movement with respect to the fixed scroll;

a first sealing member disposed between the orbiting scroll and the housing;

a second sealing member disposed between the frame scroll and the housing;

a third sealing member disposed between the frame scroll and the orbiting scroll;

a sealing portion configured to surround the first space to form a second space on an outer edge of the first space;

an intermediate pressure space portion having a predetermined depth from an opening side end surface facing the housing to form the second space;

a discharge pressure space portion having a predetermined depth from the intermediate pressure space portion, wherein the sealing portion is disposed between the discharge pressure space portion and the intermediate space portion to form the first space;

an annular protrusion disposed between the intermediate pressure space portion and the discharge pressure space portion, wherein the first sealing member is disposed in the annual protrusion;

an oil separation space portion in fluid communication with the discharge pressure space portion and comprising an exhaust port on one side; and a first passage configured to provide fluid communication between the oil separation space portion and the intermediate pressure space portion.

16. The motor operated compressor of claim 15, wherein the first sealing member is configured to float toward an opposite member based on a pressure difference between the first space and the second space.

17. The motor operated compressor of claim 15, wherein the second sealing member is configured to be brought into close contact with an outer surface of the fixed scroll and an inner surface of the housing.

18. The motor operated compressor of claim 15, wherein the third sealing member is configured to float based on a pressure of the second space.

* * * * *